US008025284B2

(12) United States Patent
Ikeuchi et al.

(10) Patent No.: US 8,025,284 B2
(45) Date of Patent: Sep. 27, 2011

(54) REMAINING SHEET VOLUME DETECTING APPARATUS AND IMAGE FORMING APPARATUS

(75) Inventors: Hiroyuki Ikeuchi, Kanagawa (JP); Takuo Matsumura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 194 days.

(21) Appl. No.: 12/559,099

(22) Filed: Sep. 14, 2009

(65) Prior Publication Data

US 2010/0133745 A1 Jun. 3, 2010

(30) Foreign Application Priority Data

Dec. 2, 2008 (JP) ..... P2008-307442

(51) Int. Cl.
*B65H 3/44* (2006.01)
*B65H 1/18* (2006.01)
*B65H 7/02* (2006.01)

(52) U.S. Cl. ..... 271/9.13; 271/25; 271/31; 271/110; 271/126; 271/130; 271/265.04; 271/152

(58) Field of Classification Search ..... 271/9.13, 271/25, 31, 110, 126, 130, 265.04, 152, 154
See application file for complete search history.

(56) References Cited

U.S. PATENT DOCUMENTS 4,397,455 A * 8/1983 Hickey ..... 271/4.03
4,852,869 A * 8/1989 Watanabe et al. ..... 271/126
5,083,762 A * 1/1992 Yoshizuka et al. ..... 271/9.05
5,700,003 A * 12/1997 Sung ..... 271/110
6,101,005 A * 8/2000 Araki et al. ..... 358/498
6,279,896 B1 * 8/2001 Linder et al. ..... 271/98
7,753,365 B2 * 7/2010 Oshima ..... 271/152
7,896,342 B2 * 3/2011 Tsukamoto et al. ..... 271/265.04
2004/0135307 A1 * 7/2004 Dobbertin et al. ..... 271/152
2006/0157921 A1 * 7/2006 Ahn et al. ..... 271/258.01
2007/0018383 A1 * 1/2007 Ohara et al. ..... 271/262
2007/0052155 A1 * 3/2007 Cook et al. ..... 271/152
2007/0096387 A1 * 5/2007 Sciurba et al. ..... 271/152
2007/0182085 A1 * 8/2007 Nakashima et al. ..... 271/126

FOREIGN PATENT DOCUMENTS

JP 10-181944 7/1998
JP 2000-16639 1/2000

* cited by examiner

*Primary Examiner* — David H Bollinger

(74) *Attorney, Agent, or Firm* — Morgan, Lewis & Bockius LLP

(57) ABSTRACT

A remaining sheet volume detecting apparatus includes a loading unit that loads a sheet; a driving unit that lifts up the loading unit to a feed position of a loaded sheet; a feeding unit that feeds a sheet from the loading unit that has reached the feed position; a load thickness detecting unit that detects a load thickness of sheets within the loading unit based on a movement amount of the loading unit until the loading unit reaches the sheet feed position; a sheet thickness detecting unit that detects a thickness of a sheet fed by the feeding unit from the loading unit that has reached the feed position; and a remaining sheet volume calculating unit that calculates remaining sheet volume within the loading unit.

6 Claims, 19 Drawing Sheets

(FIG. 6 CONTINUED)
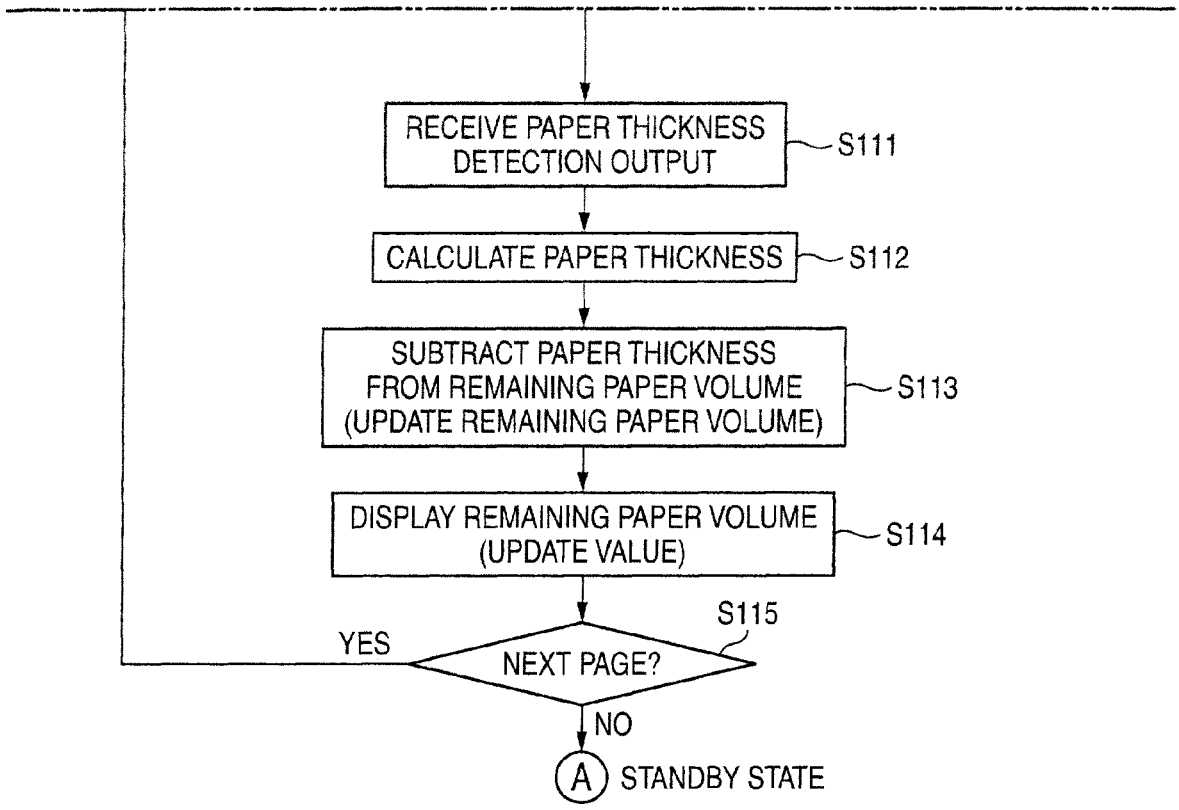

(FIG. 17 CONTINUED)
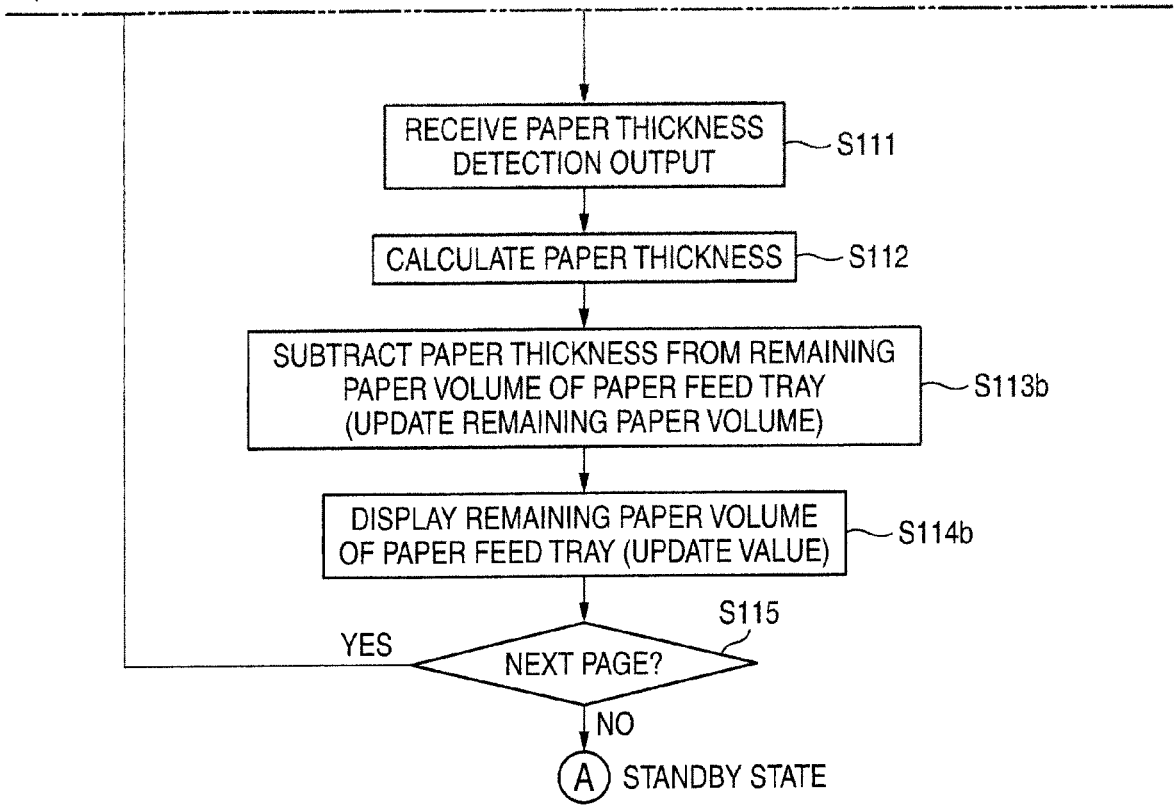

REMAINING SHEET VOLUME DETECTING APPARATUS AND IMAGE FORMING APPARATUS

CROSS-REFERENCE TO RELATED APPLICATION

This application is based on and claims priority under 35 USC 119 from Japanese Patent Application No. 2008-307442 filed on Dec. 2, 2008.

BACKGROUND

1. Technical Field

The present invention relates to a remaining sheet volume detecting apparatus and an image forming apparatus.

2. Related Art

Among various devices that load a sheet on a loading unit, feed the sheet loaded on the loading unit, and process the sheet, devices having a function of detecting remaining sheet volume are known.

For example, in an image forming apparatus such as a printer or a compound device, a paper feed tray is provided to load recording paper as the sheets, but there is a function of detecting and reporting remaining volume of recording paper (sheets) loaded within the paper feed tray for the purpose of easily determining whether or not all pages can be printed when a document is printed.

SUMMARY

According to an aspect of the invention, a remaining sheet volume detecting apparatus includes a loading unit that loads a sheet; a driving unit that lifts up the loading unit to a feed position of a loaded sheet; a feeding unit that feeds a sheet from the loading unit that has reached the feed position; a load thickness detecting unit that detects a load thickness of sheets within the loading unit based on a movement amount of the loading unit until the loading unit reaches the sheet feed position after a lift-up operation of the loading unit is started by the driving unit; a sheet thickness detecting unit that detects a thickness of a sheet fed by the feeding unit from the loading unit that has reached the feed position; and a remaining sheet volume calculating unit that calculates remaining volume of sheets within the loading unit at the feed position based on the load thickness detected by the load thickness detecting unit and the sheet thickness detected by the sheet thickness detecting unit.

BRIEF DESCRIPTION OF THE DRAWINGS

Exemplary embodiments of the invention will be described in detail based on the following figures, wherein.

DETAILED DESCRIPTION

Hereinafter, an exemplary embodiment of the present invention will be described in detail with reference to the accompanying drawings.

Figure 1:
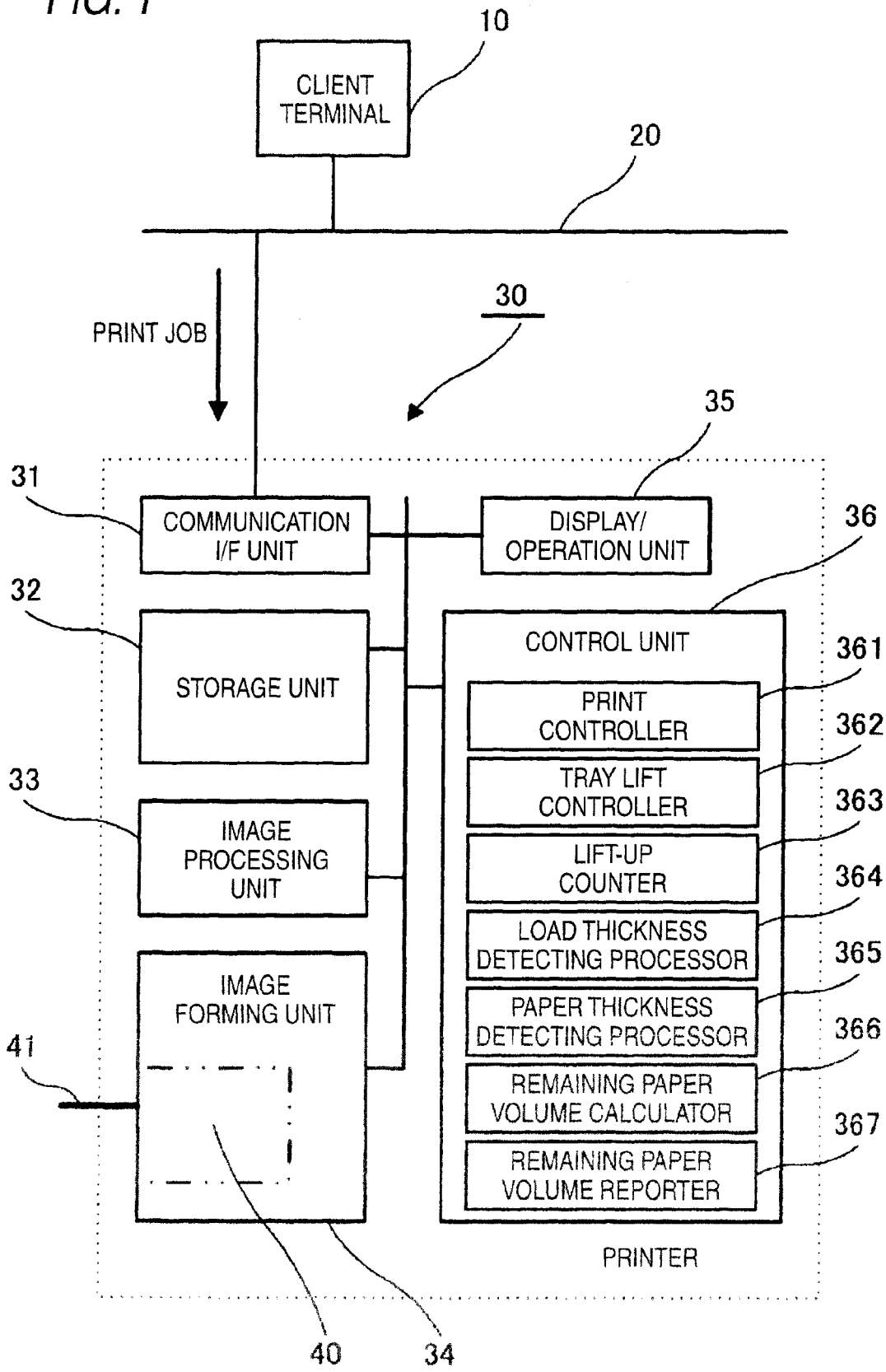
FIG. 1 is a block diagram showing a functional structure of a printer as an example of the present invention.

FIG. 1 is a block diagram showing a function structure of a printer 30 as an example of the present invention.

The printer 30 includes a communication interface (I/F) unit 31 that is connected to one or more client terminals 10 including a PC (personal computer), etc., through a network (NW) 20 such as a LAN (Local Area Network) or a WAN (Wide Area Network) and is responsible for a communication interface upon communication with the client terminals 10 through the NW 20; a storage unit 32 that stores an operation program and various information such as document information (image data) of a print object included in a print instruction (print JOB) received from the client terminal 10 through the communication I/F unit 31; an image processing unit 33 that processes an image to generate print data from the document information (image data) of the print object stored in the storage unit 32; an image forming unit 34 that forms (prints) an image on a recording medium (recording paper) by executing an image forming process of electronic photography on the basis of print data generated by the image processing unit 33 and discharges (outputs) the image; a display/operation unit 35 including a display unit such as a liquid crystal display (LCD) and an operation unit having various operation keys such as a numeric keypad; and a control unit 36 that controls the entire apparatus.

The printer 30 is provided with a paper feed tray 41 that loads recording paper (hereinafter, paper) as a mechanism related to image formation of the image forming unit 34, and a paper feeder 40 that transports (feeds) paper loaded on the paper feed tray 41 to the image forming process.

Figure 2:
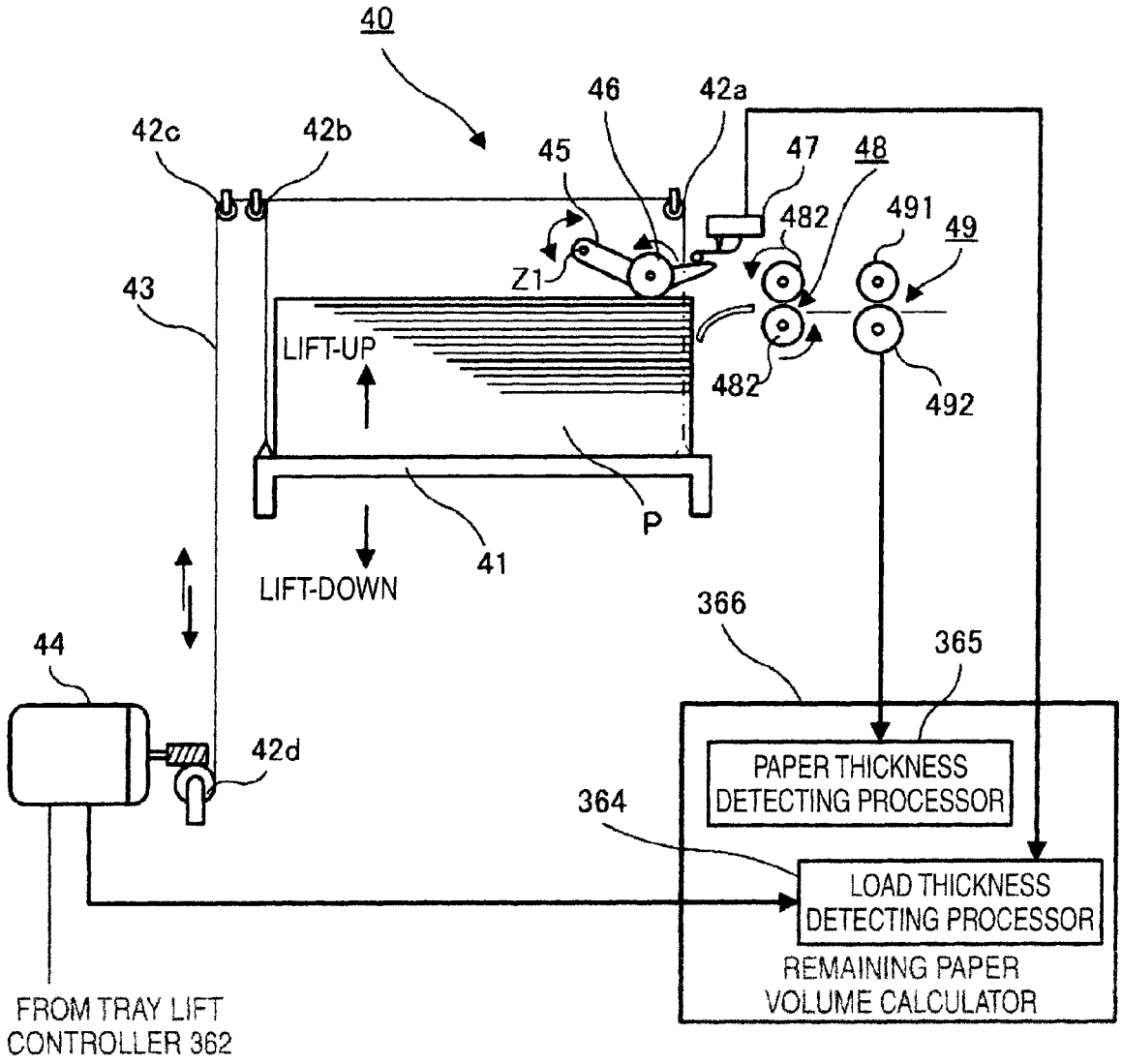
FIG. 2 is a diagram showing a schematic structure of a paper feeder of the printer.

FIG. 2 is a view showing a schematic structure of the paper feeder 40 of the printer 30 as an example of the present invention.

As shown in FIG. 2, the paper feeder 40 of the printer 30 includes a paper feed tray 41 provided as an example of a loading unit and mounted to an apparatus main body so as to be capable of being drawn from the apparatus main body, which loads paper (indicated by a sign P) in a state in which the paper feed tray 41 is drawn from the apparatus main body [which can selectively load (set) one or more types of paper pieces among various paper pieces of different types of size, thickness, or backing paper], and is able to be lifted up from a position, in a state in which it is mounted to the apparatus main body, to a feed position of loaded paper; a wire 43 arranged across from an upper surface end of the paper feed tray 41 to a winding pulley 42*d* through pulleys 42*a*, 42*b*, and 42*c*; a tray lift drive mechanism provided as an example of a driving unit and having a drive motor 44 to forwardly/reversely rotate the pulley 42*d*, which can lift up the paper feed tray 41, mounted to the apparatus main body, to the paper feed position after the load of paper, for example, by forwardly rotating the winding pulley 42*d* using the drive motor 44 and winding the wire 43 and lift down the paper feed tray 41 to a set position at which paper is set by reversely rotating the winding pulley 42*d* using the drive motor 44 and winding and extending the wire 43; a delivery roller 46 which is rotatably supported to a cam 45 turning around an axis Z1 and sequentially delivers paper loaded on the paper feed tray 41 lifted up to the paper feed position from paper at the top position sheet by sheet; a limit sensor 47 which generates a detection output (changing from an off state to an on state) indicating the paper feed position (detects that the paper feed tray 41 has reached the paper feed position) by that the paper at the top position is in contact with (pressed by) the other end of the cam 45 rotating around the axis Z1 in an operation for pushing up the delivery roller 46 when the paper feed tray 41 is lifted up; a paper feed roller 48, provided as a feeding unit, which includes a drive roller 481 and a separation roller 482 (rotatable in a reverse direction to the drive roller 481 through a torque limiter) pressed to, and in contact with, the drive roller 481, introduces paper, delivered by the delivery roller 46 sheet by sheet from the paper feed tray 41 reached the paper feed position, between the two rollers 481 and 482 in synchronization with image transfer timing, and transports the paper in a transfer position direction; and a paper thickness detecting roller 49, provided at a downstream side of a paper transport direction of the paper feed roller 48, which detects a thickness of paper transported by the paper feed roller 48.

Figure 3:
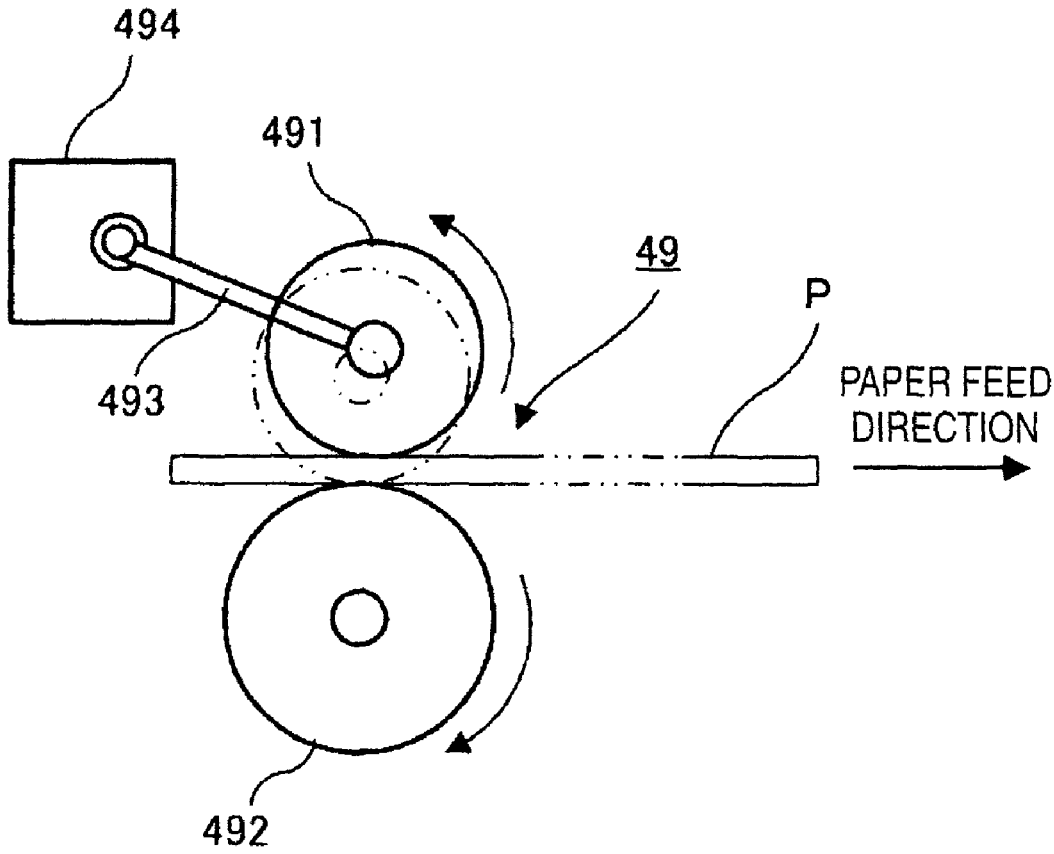
FIG. 3 is a schematic structure of a paper thickness detecting roller and a paper thickness sensor as an example of the present invention.

As shown in FIG. 3, for example, the paper thick detecting roller 49 includes a movable roller 491 rotatably supported to a tip portion of a detecting lever 493 capable of turning around a rotary axis Z2 and a facing roller 492 rotatably supported at a position facing a lower side of the movable roller 491.

In FIG. 3, the paper thickness sensor 494 is a sensor, which detects a change of a rotation angle of the detecting lever 493 (the rotary axis Z2), for example, electromagnetically, when the detecting lever 493 turns after the movable roller 491 is lifted up according to a paper thickness when paper transported by the paper feed roller 48 passes between the movable roller 491 and the facing roller 492. A detection output is sent to a paper thickness detecting processor 365.

In the printer 30 having the paper feeder 40 (see FIG. 2) of this structure, the control unit 36 is provided with a print controller 361, a tray lift controller 362, a lift-up counter 363, a load thickness detecting processor 364, the paper thickness detecting processor 365, a remaining paper volume calculator 366, and a remaining paper volume reporter 367 as shown in FIG. 1.

The print controller 361 receives a print instruction from the client terminal 10 through the communication I/F unit 31, generates print data by the image processing unit 33 from document information (image data) of a print object included in the print instruction, and performs a print control operation to form and discharge an image based on the print data on the paper by delivering and transporting the paper from the paper feed tray 41 in synchronization with image transfer timing after supplying the print data to the image forming unit 34 and initiating an electronic photography process.

For example, by performing a predetermined lift-up instruction operation after the paper feed tray 41 where paper is set is mounted to the apparatus main body (or detecting that the paper feed tray 41 is mounted to the apparatus main body), the tray lift controller 362 performs a control operation to start the above-described forward rotation of the drive motor 44 and lift up the paper feed tray 41 until it is recognized that the paper feed tray 41 reaches a paper feed position on the basis of a detection output (for example, output "ON") of the limit sensor 47, a control operation to constantly maintain the paper feed tray 41 at the paper feed position by continuously lifting up the paper feed tray 41 until the output of the limit sensor 47 becomes "ON" whenever the detection output of the limit sensor 47 is lost (output "OFF") during a print operation due to the feed of paper from the paper feed tray 41 lifted up to the paper feed position, and a control operation to reversely rotate the drive motor 44 and lift down the paper feed tray 41 to a paper set position (a position where drawing is possible) as described above by performing a predetermined lift-down instruction operation when paper for the paper feed tray 41 is set.

After the lift-up operation of the paper feed tray 41 is started by the drive motor 44, the lift-up counter 363 counts a lift-up operation time (lift-up time) until the paper feed tray 41 reaches the paper feed position (until an output of the limit sensor 47 becomes "ON").

The load thickness detecting processor 364 provided as an example of load thickness detecting unit, is a processor that detects thickness of paper (a thickness of a total quantity of paper) loaded on the paper feed tray 41 on the basis of a movement amount of the paper feed tray 41 until the sheet feed position is reached after the paper feed tray 41 starts to be lifted up by the drive motor 44 when paper is set on the paper feed tray 41. For example, it detects thickness of paper loaded in the paper feed tray 41 on the basis of a movement time of the paper feed tray 41 during the lift-up operation, that is, a lift-up time of the paper feed tray 41 counted by the lift-up counter 363.

The paper thickness detecting processor 365, provided as an example of sheet thickness detecting unit, performs a process that detects a thickness of paper being fed on the basis of a detection output of the paper thickness sensor 494 (see FIG. 3) when paper delivered and transported (fed) from the paper feed tray 41, which has reached the paper feed position, passes between the two rollers of the paper thickness detecting roller 49.

The remaining paper volume calculator 366, provided as an example of a remaining sheet volume calculating unit, performs a process to calculate a remaining volume of paper loaded on the paper feed tray 41 when the paper feed tray 41 is able to feed paper at the paper feed position, on the basis of the paper load thickness detected by the load thickness detecting processor 364 and the thickness of fed paper detected by the paper thickness detecting processor 365.

The remaining paper volume reporter 367 displays the remaining paper volume calculated by the remaining paper volume calculator 366, for example, on the display unit (providing as an example of displaying unit) of the display/operation unit 35, thereby reporting the remaining paper volume to the user.

As described with reference to FIGS. 1 and 2, the printer 30 as an example of the present invention includes the loading unit (the paper feed tray 41) for loading a sheet (paper) to be used as a recording medium; the driving unit (the tray lift controller 362) for lifting up the loading unit to a feed position of loaded paper; the feeding unit (the delivery roller 46 and the paper feed roller 48) for feeding paper from the paper loading unit that has reached the feed position; a load thickness detecting unit (the load thickness detecting processor 364) for detecting a load thickness of paper within the loading unit on the basis of a movement amount of the loading unit (for example, a lift-up time of the loading unit) until the loading unit reaches the paper feed position after a lift-up operation of the loading unit is started by the driving unit; paper thickness detecting unit (the paper thickness sensor 494 and the paper thickness detecting processor 365) for detecting a thickness of paper to be fed by the feeding unit from the paper loading unit that has reached the feed position; and the remaining paper volume calculating unit (the remaining paper volume calculator 366) for calculating remaining volume of paper within the loading unit at the feed position on the basis of the load thickness detected by the load thickness detecting unit and the paper thickness detected by the paper thickness detecting unit.

Figure 4:
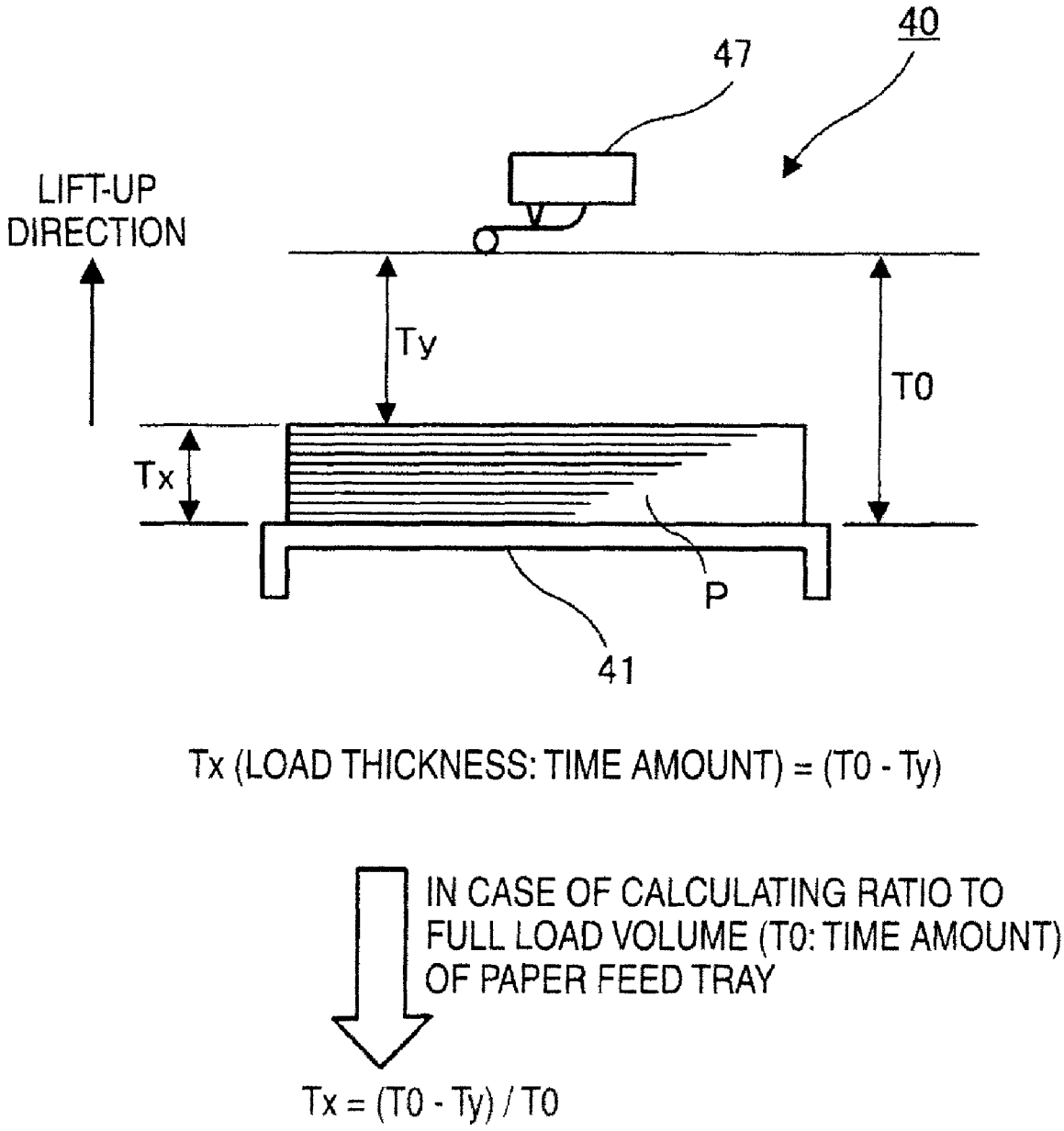
FIG. 4 is a conceptual diagram showing a paper load thickness detecting principle based on a remaining paper volume detecting method of the present invention.

FIG. 4 is a conceptual diagram showing a principle of processing when the load thickness detecting processor 364 of the remaining sheet volume detecting apparatus provided in the printer 30 of the present invention detects a load thickness of paper within the paper feed tray 41 on the basis of a lift-up time of the paper feed tray 41.

In FIG. 4, T0 denotes a time required to lift up the paper feed tray 41 when the paper feed tray 41 is in an empty state (a time until the paper feed tray 41 reaches the paper feed position after the lift-up operation of the paper feed tray 41 is started by the drive motor 44).

In FIG. 4, Ty denotes a time required to lift up the paper feed tray 41 when paper is loaded on the paper feed tray 41 by a thickness corresponding to a time denoted by Tx of FIG. 4.

That is, when the lift-up time is Ty in which the paper feed tray 41 is lifted up, a total thickness (load thickness) Tx of paper loaded on the paper feed tray 41 becomes a value (time value) corresponding to a time (T0-Ty) in which an actual lift-up time Ty is subtracted from the lift-up time T0 in which the paper feed tray 41 is empty.

Here, when the paper load thickness Tx in the paper feed tray 41 is calculated as a ratio to a maximum load quantity N of the paper feed tray 41 (a quantity corresponding to a full load: "Full" level to be described later), it becomes a value obtained by subtracting the actual lift-up time Ty from the lift-up time T0 upon emptying and then dividing the subtraction value by the lift-up time T0 of the emptying time.

According to the remaining sheet volume detecting apparatus, when the lift-up time Ty of the paper feed tray 41 is detected, the load thickness Tx of paper loaded on the paper feed tray 41 at the time (only the ratio to the maximum load quantity N) can be calculated by applying the lift-up time Ty to the following Expression (1).

$$Tx(\text{load thickness})=(T0-Ty)/T0 \quad (1)$$

Figure 5A:
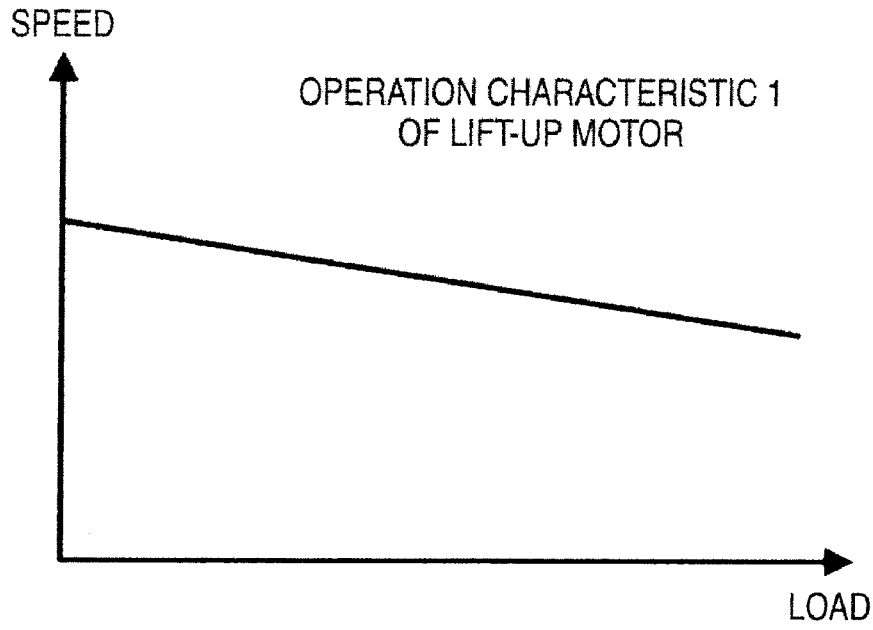
FIGS. 5A and 5B are diagrams showing operation characteristics of a lift-up motor used in a lift-up operation of a paper feed tray.
Figure 5B:
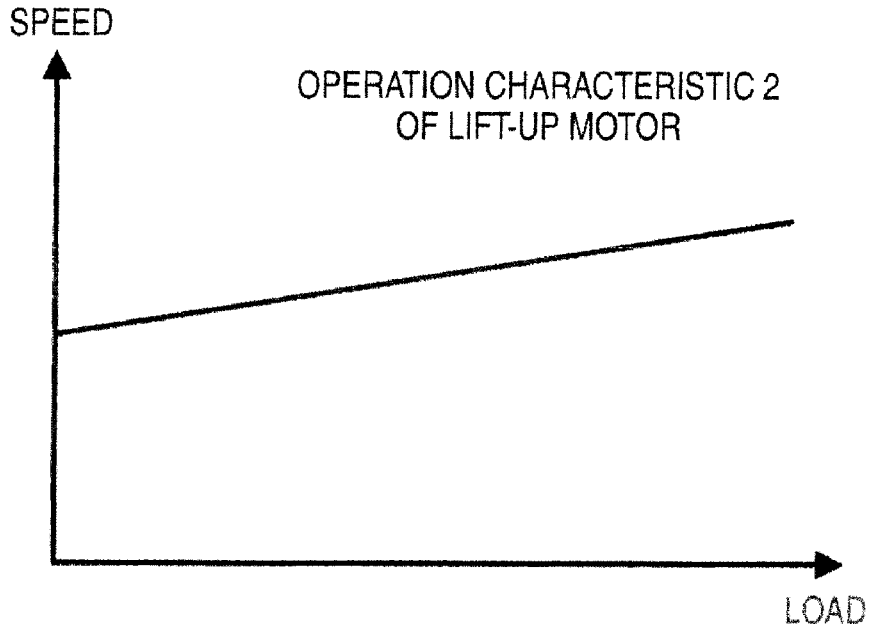

FIGS. 5A and 5B are diagrams showing operation characteristics of the drive motor (lift-up motor) 44 used for the lift-up operation of the paper feed tray 41 in the printer 30 as an example of the present invention.

The drive motor 44 has a characteristic that a rotation speed decreases as a load (a load quantity of paper within the paper feed tray 41) increases as shown in FIG. 5A, and has a characteristic that a movement time of the paper feed tray 41 increases as the load increases as shown in FIG. 5B.

When using the drive motor 44 having these operation characteristics, detecting a load thickness of paper within the paper feed tray 41 on the basis of the lift-up time when the paper feed tray 41 on which paper is set is lifted up, and calculating a quantity of use of paper fed (used for printing), a related general opinion is that an error occurs due to a load quantity of paper in detection of a load thickness since a movement time per unit movement distance of the paper feed tray 41 is long as a load quantity of paper on the paper feed tray 41 is large (the movement time is short as the load quantity of paper is small).

The present invention realizes high-precision remaining sheet volume detection by sequentially subtracting an accurate thickness of paper used (fed) for printing from a load quantity calculated in the detecting process upon paper setting, without requiring paper information such as size, paper quality, and environmental information and without causing an error in the load quantity.

Exemplary Embodiment 1

Figure 6:
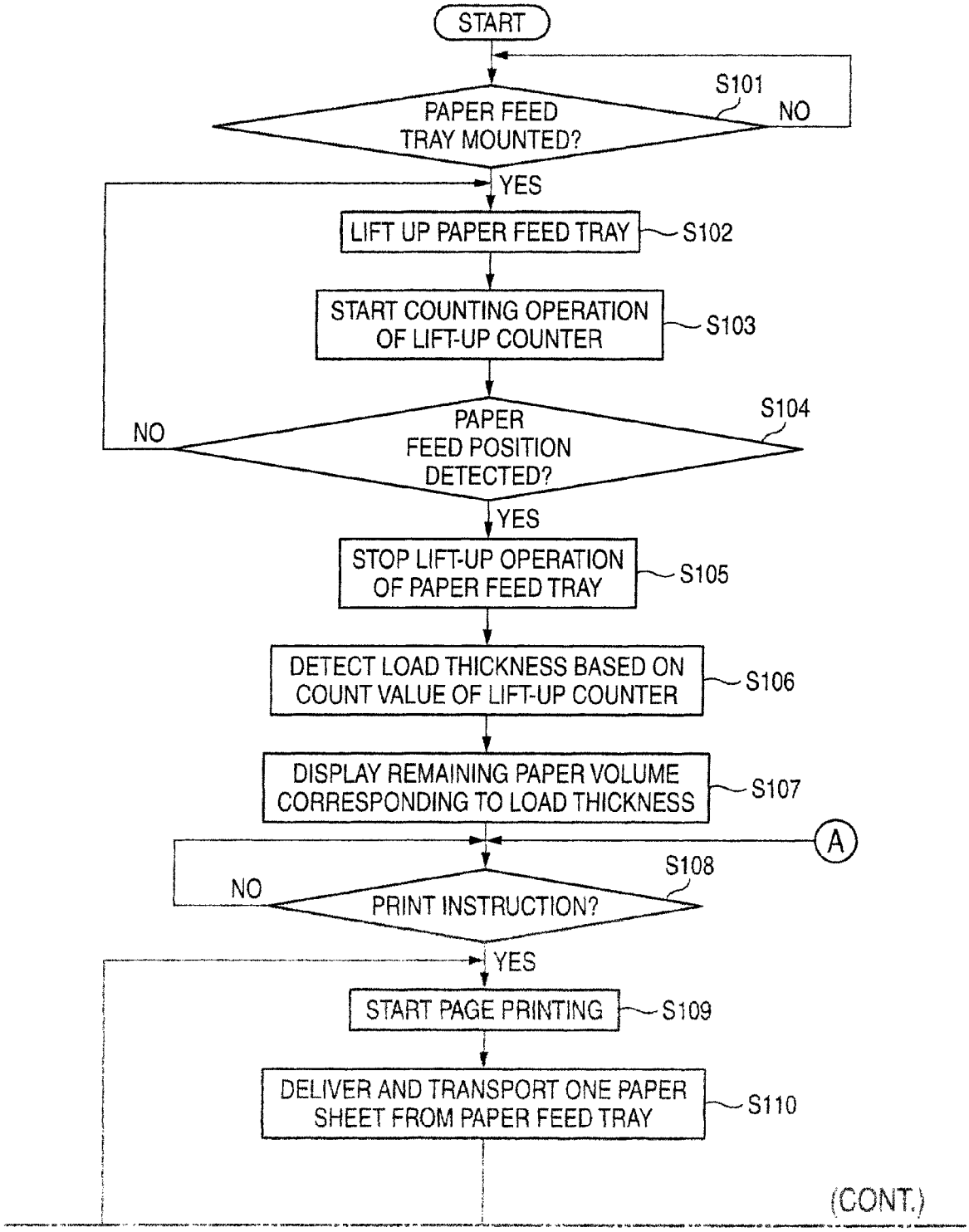
FIG. 6 is a flowchart showing a remaining paper volume calculating process operation of the printer according to an exemplary embodiment 1.

FIG. 6 is a flowchart showing a remaining paper volume calculating process operation of the printer 30 according to this exemplary embodiment.

In particular, FIG. 6 considers a process operation when lifting up the paper feed tray 41 to the paper feed position, after drawing the paper feed tray 41 and loading (setting) paper, and feeding the paper from the position upon printing.

As shown in FIG. 6, the tray lift controller 362 of the printer 30 monitors whether or not the paper feed tray 41 is mounted in a state in which the paper feed tray 41 is extracted from the apparatus main body (step S101).

Here, when the mounting of the paper feed tray 41 filled with paper is detected (step S101: YES), the tray lift controller 362 rotates the drive motor 44 in a direction of winding the wire 43 using the winding pulley 42*d* by recognizing that an output of the limit sensor 47 is "OFF", and starts the lift-up operation of the paper feed tray 41 (step S102).

Then, the tray lift controller 362 starts the lift-up counter 363 to count a time (lift-up time) from a point of time when the lift-up operation of the paper feed tray 41 is started (step S103), and checks whether or not the paper feed tray 41 has reached the paper feed position by monitoring the output of the limit sensor 47 (step S104).

Here, when it is determined that the paper feed position is not reached by the fact that the output of the limit sensor 47 is "OFF" (step S104: NO), the lift-up operation of the paper feed tray 41 is continued (step S102).

When it is determined that the paper feed position is reached by the fact that the output of the limit sensor 47 is "ON" while the lift-up operation of the paper feed tray 41 is continued (step S104: YES), the tray lift controller 362 stops the lift-up operation of the paper feed tray 41 and the counting operation of the lift-up counter 363 (step S105) and proceeds to a load thickness detecting process.

If the transition to the load thickness detecting process is made, the load thickness detecting processor 364 reads a count value (lift-up time) of the lift-up counter 363 when the counting operation is stopped in step S105 and detects a load thickness of paper within the paper feed tray 41 using the above-described Expression (1) on the basis of the lift-up time (step S106).

Figure 7A:
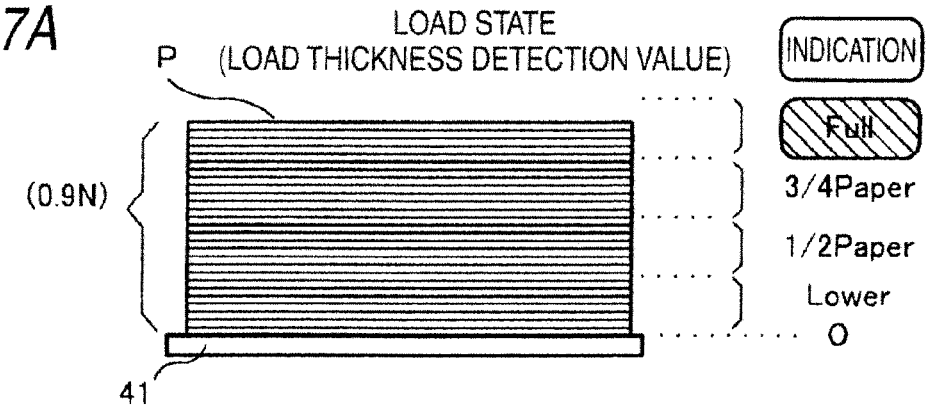
FIGS. 7A to 7D are conceptual diagrams showing an example of displaying a paper load state and a detected remaining paper volume of the paper feed tray.

When the paper feed tray 41 is actually lifted up for 0.3 sec in the case where the paper feed tray 41 is lifted up, for example, for 3 sec, in the empty state in the load thickness detecting process (Lift-Up Time T0="3"), a load thickness corresponding to [(3−0.3)/3=0.9] from the above-described Expression (1), that is, a level of 9/10 of the load thickness "1" corresponding to the "Full" level, is detected (corresponding to a remaining paper volume level shown in FIG. 7A).

Figure 7B:
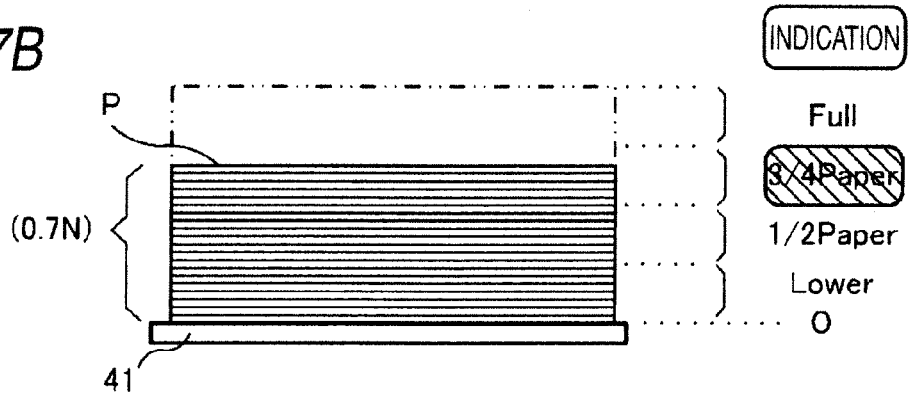

When the paper feed tray 41 is lifted up for 0.9 sec after paper is set using the same paper feed tray 41, a load thickness corresponding to [(3−0.9)/3=0.7] from the above-described Expression (1), that is, a level of 7/10 of the load thickness "1" corresponding to the "Full" level, is detected (corresponding to a remaining paper volume level shown in FIG. 7B).

Figure 7C:
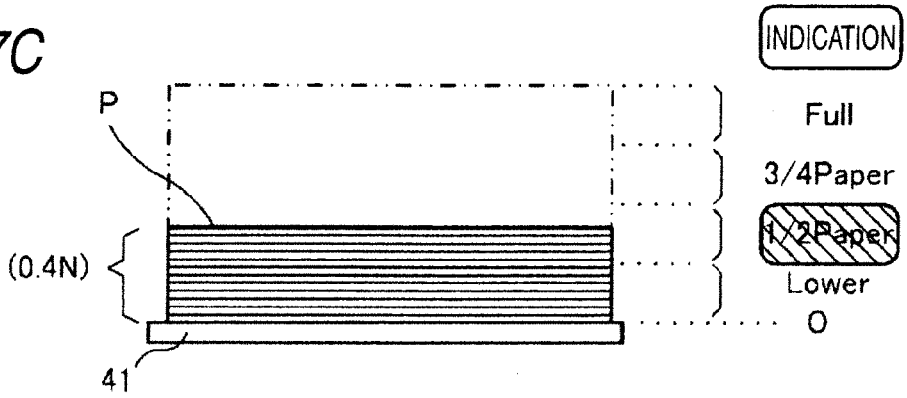

When the paper feed tray 41 is lifted up for 1.8 sec after paper is set using the same paper feed tray 41, a load thickness corresponding to [(3−1.8)/3=0.4] from the above-described Expression (1), that is, a level of 4/10 of the load thickness "1" corresponding to the "Full" level, is detected (corresponding to a remaining paper volume level shown in FIG. 7C).

Figure 7D:
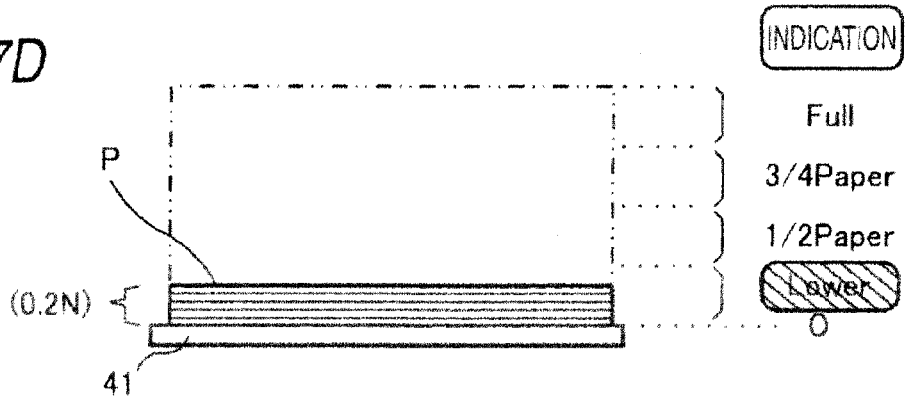

When the paper feed tray 41 is lifted up for 2.4 sec after paper is set using the same paper feed tray 41, a load thickness corresponding to [(3-2.4)/3=0.2] from the above-described Expression (1), that is, a level of 2/10 of the load thickness "1" corresponding to the "Full" level, is detected (corresponding to a remaining paper volume level shown in FIG. 7D).

After a total thickness (load thickness) of paper set on the paper feed tray 41 is detected upon paper setting in step S106 as described above, the remaining paper volume reporter 367 displays remaining volume of paper within the paper feed tray 41 at this time, for example, on the display unit of the display/operation unit 35, on the basis of the detected load thickness (step S107).

Next, details of the remaining paper volume displaying process of step S107 and a remaining paper volume displaying process of step S114 to be described later will be described with reference to FIG. 7A to 7D.

After the remaining volume of paper within the paper feed tray 41 is displayed in step S107, the print controller 361, for example, monitors whether or not there is a print instruction from the client terminal 10 (step S108), and causes the image processing unit 33 to generate print data by extracting image information of a first page of a print-instructed document when the print instruction exists (step S108: YES), and starts print control of the page at the image forming unit 34 on the basis of the print data (step S109).

When paper feed timing is reached in the printing of the page after the print control is started, the print controller 361 causes the delivery roller 46 to deliver one sheet of paper from the paper feed tray 41 and then causes the paper feed roller 48 to transport the paper to a transfer position (step S110).

When paper passes between the movable roller 491 and the facing roller 492 of the paper thickness detecting roller 49 during the paper transport (feed), the movable roller 491 is lifted up according to a thickness of the paper to turn the detecting lever 493, so that the paper thickness sensor 494 outputs a turning angle, that is, a thickness detection signal corresponding to the paper thickness.

Then, the paper thickness detecting processor 365 receives the thickness detection signal of the paper thickness sensor 494 (step S111) and detects a thickness of paper being transported on the basis of the thickness detection signal (step S112).

Subsequently, the remaining paper volume calculator 366 performs a process to calculate a remaining volume of paper currently loaded on the paper feed tray 41 on the basis of the total load thickness of paper detected by the load thickness processor 364 in step S106 and the thickness of fed paper (one sheet) detected by the paper thickness detecting processor 365 in step S112 (step S113).

Continuously the remaining paper volume reporter 367 displays the remaining paper volume calculated in step S113 on the display unit of the display/operation unit 35 (step S114).

Continuously, the print controller 361 checks whether or not the next page exists (step S115), returns to step S109 when it is determined that the next page exists (step S115: YES), and starts the printing of the page (step S109).

Then, after a thickness of paper fed to print a corresponding page through steps S110 to S112 is detected in the same way after the first sheet starts printing, a corresponding remaining paper volume is updated by subtracting the detected thickness corresponding to one sheet of paper from a remaining paper volume calculated at the time (step S113) and the updated remaining paper volume is displayed on the display unit of the display/operation unit 35 (step S114).

Then, while a page of an object to be printed exists (step S115: YES), the update of the remaining paper volume (step S113) and the display of the updated remaining paper volume (step S114) are performed by repeating the process of steps S109 to S114. When it is determined that the next page does not exist (step S115: NO), the process is terminated and the transition to the standby state is made.

It is monitored whether or not a print instruction exists even in the standby state. Whenever the print instruction exists (step S108), a process, which detects a thickness of fed paper, updates a corresponding remaining paper volume by subtracting the detected thickness corresponding to one paper sheet from a remaining paper volume at the time, and displays the updated remaining paper volume, is performed as described above (steps S109 to S115).

Next, a specific example of displaying a remaining paper volume in steps S107 and S114 of FIG. 6 will be described.

When the maximum load quantity ("Full" level) of the paper feed tray 41 is set to "N" in the printer 30 of the present invention, the remaining paper volume reporter 367 displays remaining paper volume corresponding to a remaining volume level of each range of plural of ranges into which the maximum load volume is divided, for example, (N to ¾N), (¾N to ¾N), (¾N to ¼N), and (¼N to 0).

To realize this, the remaining paper volume reporter 3 67 holds in advance threshold values of, for example, "¾"="0.75", "¾"="0.5", and "¼"="0.25", so as to determine which of the above-described remaining volume levels the load thickness Tx belongs to by comparison with the paper load thickness Tx detected upon paper setting.

In step S107 among a series of processes (steps S101 to S107) upon paper setting in FIG. 6, it is determined whether the load thickness Tx of paper within the paper feed tray 41 detected in step S106 is at a remaining volume level of one of [(N to ¾N), (¾N to ¾N), (¾N to ¼N), and (¼N to 0)] described above by comparison with the above-described threshold values of "0.75", "0.5", "0.25", etc., and the remaining volume corresponding to the determined remaining volume level is displayed.

Then, in step S114 among a series of processes (steps S108 to S115) upon printing (paper feeding) in FIG. 6, it is determined which of the above-described remaining volume level corresponds to a current volume of paper updated by subtracting a thickness of one sheet of fed paper detected in step S112 from remaining paper volume before feeding in step S113 and comparing with the threshold values, and the remaining volume corresponding to the determined remaining volume level is displayed.

FIGS. 7A to 7D are conceptual diagrams showing a combination of display examples of load states of paper within the paper feed tray 41 (the left portion of FIGS. 7A to 7D) and remaining paper volume corresponding to remaining paper volume values 0.9N, 0.7N, 0.4N, and 0.2N detected in these states (the right portion of FIGS. 7A to 7D).

FIG. 7A illustrates remaining paper volume display example when paper corresponding to a quantity in a range of N (maximum load quantity) to ¾N is loaded on the paper feed tray 41 and a value of "0.9" is detected as the remaining paper volume.

At this time, since the detected remaining paper volume of "0.9" exceeds the threshold value of "0.75", the remaining paper volume reporter 367 determines that it is in remaining volume level range of N to ¾N, and displays the remaining paper volume, for example, as information content "Full".

FIG. 7B illustrates remaining paper volume display example when paper corresponding to a quantity in a range of ¾N to ½N is loaded on the paper feed tray 41 and a value of "0.7" is detected as the remaining paper volume.

At this time, since the detected remaining paper volume of "0.7" is smaller than the threshold value of "0.75" and exceeds the threshold value of "0.5", the remaining paper volume reporter 367 determines that it is in remaining volume level range of ¾N to ½N, and displays the remaining paper volume, for example, as information content "¾ Paper".

FIG. 7C illustrates a remaining paper volume display example when paper corresponding to a quantity in a range of ½N to ¼N is loaded on the paper feed tray 41 and a value of "0.4" is detected as the remaining paper volume.

At this time, since the detected remaining paper volume of "0.4" is smaller than the threshold value of "0.5" and exceeds the threshold value of "0.25", the remaining paper volume reporter 367 determines that it is in remaining volume level range of ½N to ¼N, and displays the remaining paper volume, for example, as information content "½ Paper".

FIG. 7D illustrates a remaining paper volume display example when paper corresponding to a quantity in a range of ¼N to 0 is loaded on the paper feed tray 41 and a value of "0.2" is detected as the remaining paper volume.

At this time, since the detected remaining paper volume of "0.2" is smaller than the threshold value of "0.25" and exceeds the threshold value of "0", the remaining paper vikyne reporter 367 determines that it is in remaining volume level range of ¼N to 0, and displays the remaining paper volume, for example, as content "Lower".

When the detected remaining paper volume is "0(zero)", the remaining paper volume reporter 367 displays it, for example, as information content "0".

Next, a specific example of performing high-precision remaining paper volume detection based on the remaining paper volume detecting method of the present invention will be verified.

Figure 8A:
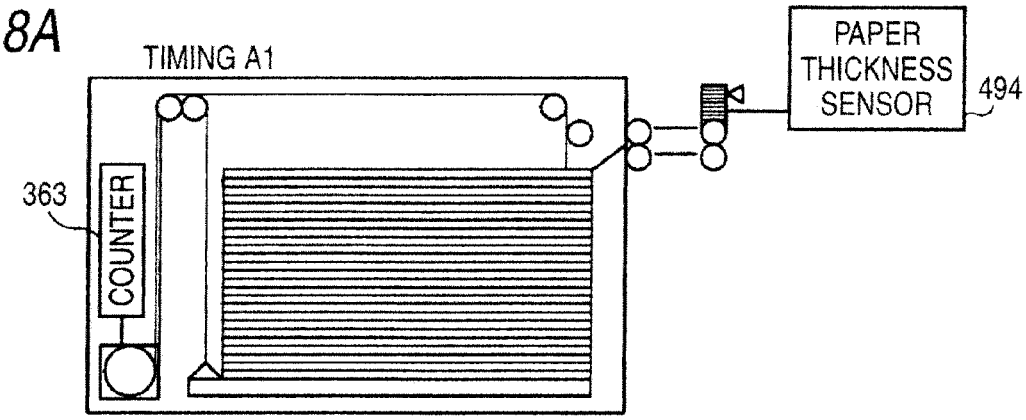
FIGS. 8A to 8D are diagrams showing operation transition related to a remaining paper volume calculating process at the time of a large load of a large size.
Figure 8B:
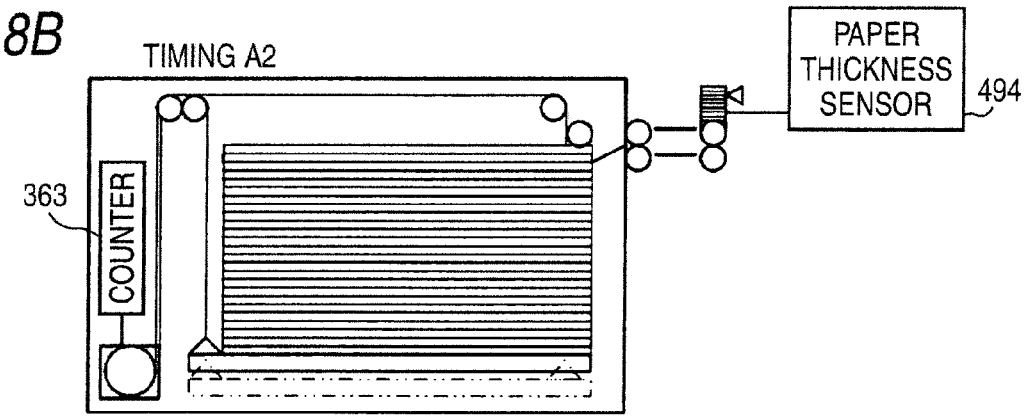
Figure 8C:
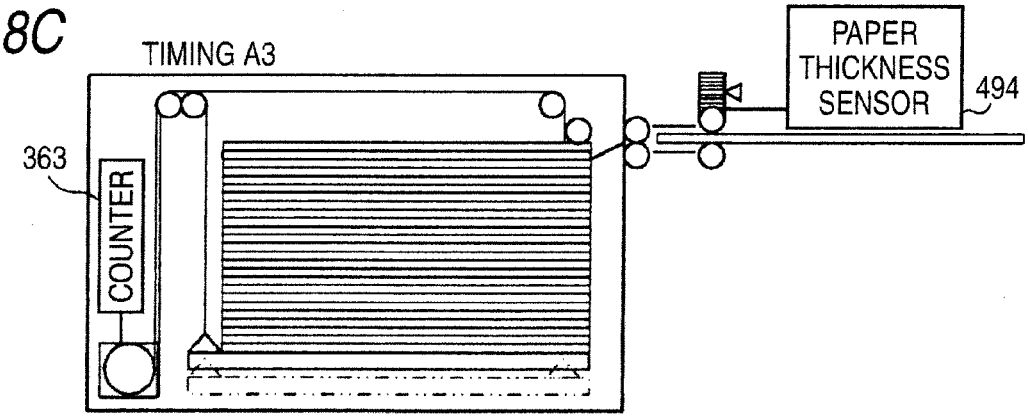
Figure 8D:
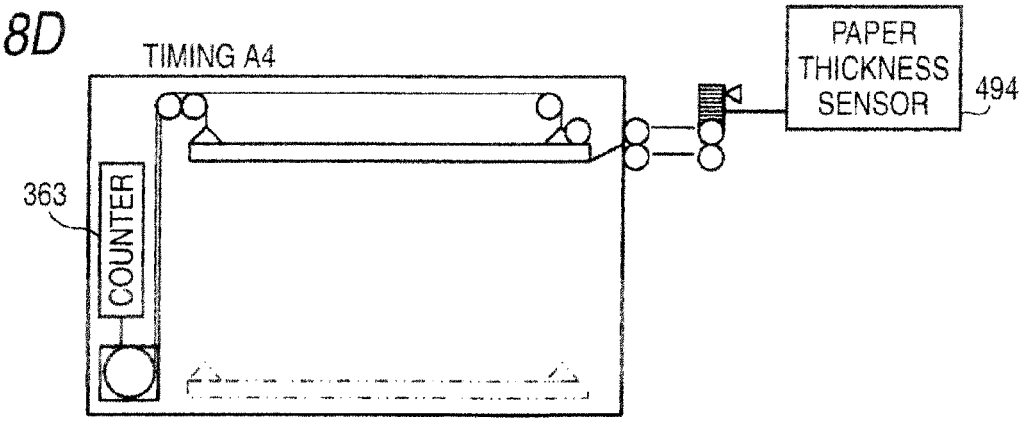

FIGS. 8A to 8D are specific examples of a remaining paper volume detecting process when a load quantity is large, and illustrate operation transition states, for example, in which the paper feed tray 41 on which A3 size paper whose quantity corresponds to the "Full" level is loaded starts to be lifted up at timing A1 (see FIG. 8A), the lift-up operation to the paper feed position is completed at timing A2 (see FIG. 8B), the printing is executed while feeding paper and detecting a thickness of the paper after timing A3 (see FIG. 8C), and there is no paper within the paper feed tray 41 at timing A4 (see FIG. 8D).

Figure 9A:
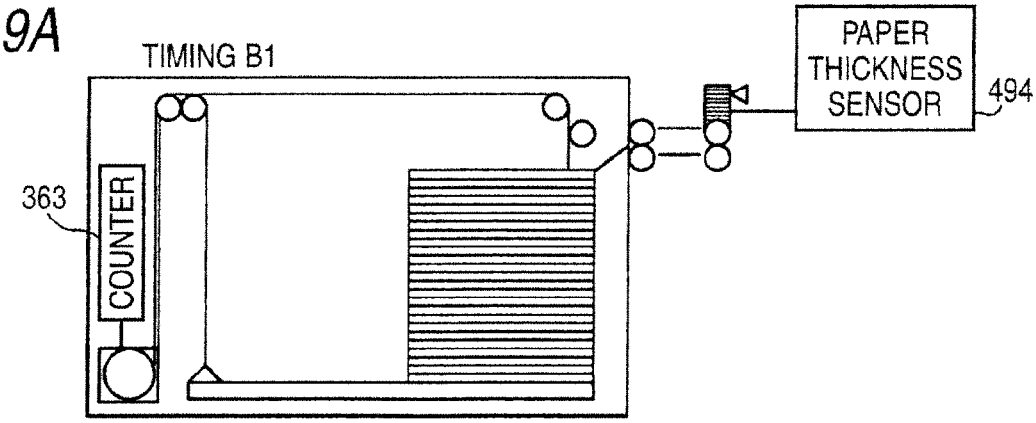
FIGS. 9A to 9D are diagrams showing operation transition related to a remaining paper volume calculating process at the time of a large load of a small size.
Figure 9B:
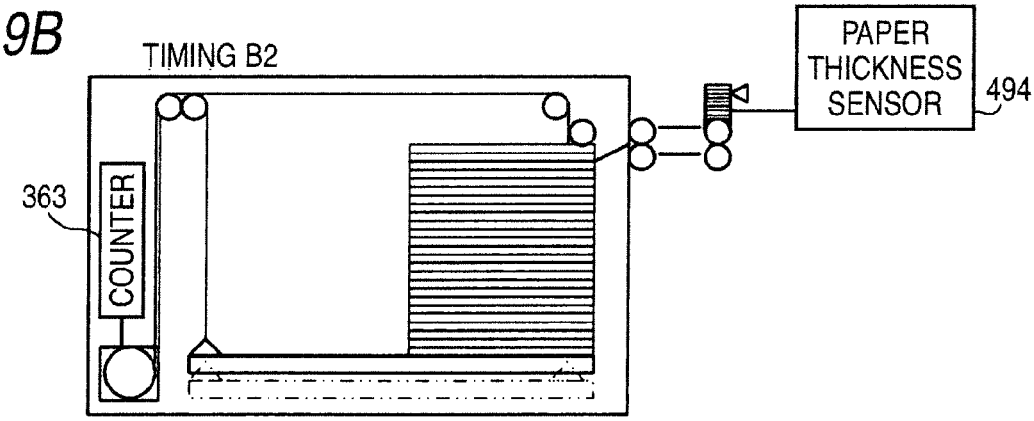
Figure 9C:
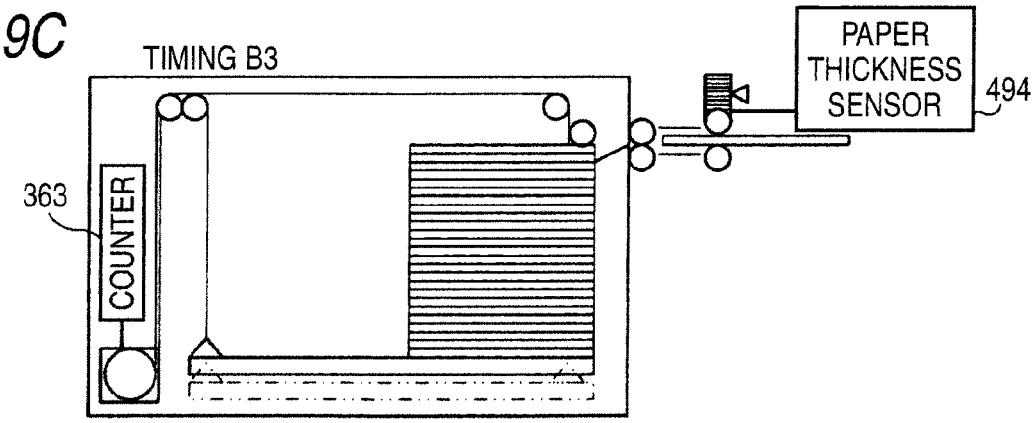
Figure 9D:
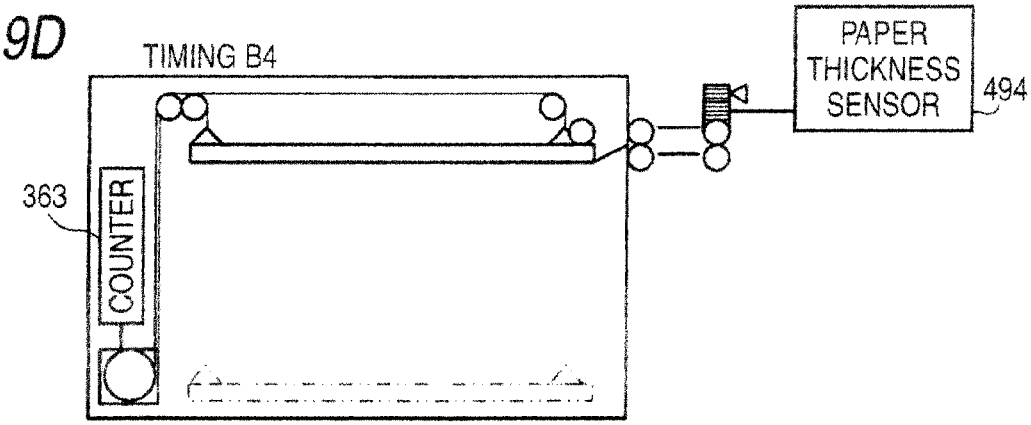

Likewise, FIGS. 9A to 9D are other specific examples of the remaining paper volume detecting process when the load quantity is large, and illustrate operation transition states, for example, in which the paper feed tray 41 on which A4 size paper whose quantity corresponds to the "Full" level is loaded starts to be lifted up at timing B1 (see FIG. 9A), the lift-up operation to the paper feed position is completed at timing B2 (see FIG. 9B), the printing is executed while feeding paper and detecting a thickness of the paper after timing B3 (see FIG. 9C), and there is no paper within the paper feed tray 41 at timing B4 (see FIG. 9D).

Figure 10A:
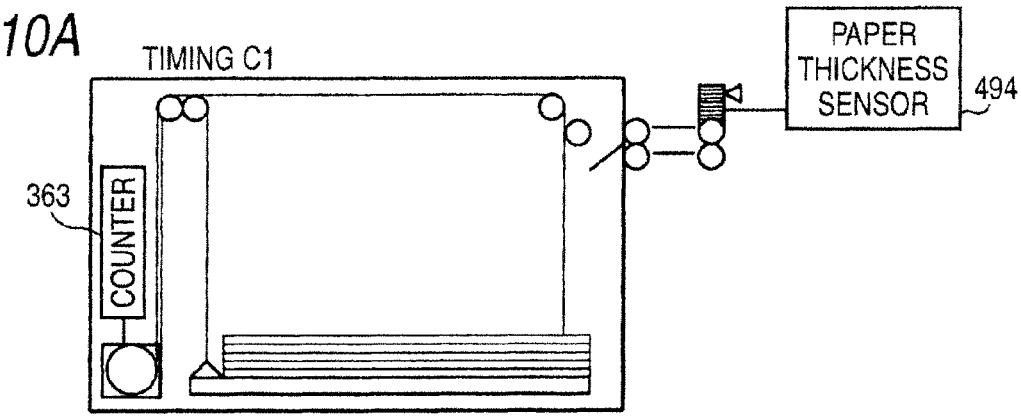
FIGS. 10A to 10D are diagrams showing operation transition related to a remaining paper volume calculating process at the time of a small load of a large size.
Figure 10B:
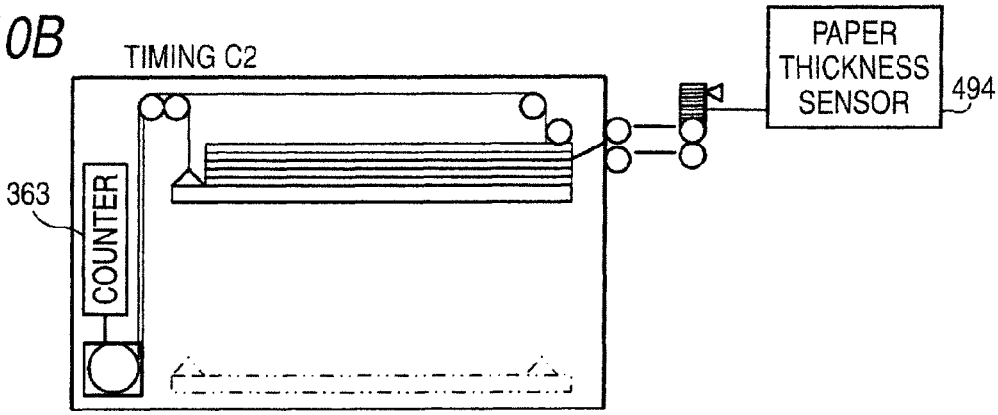
Figure 10C:
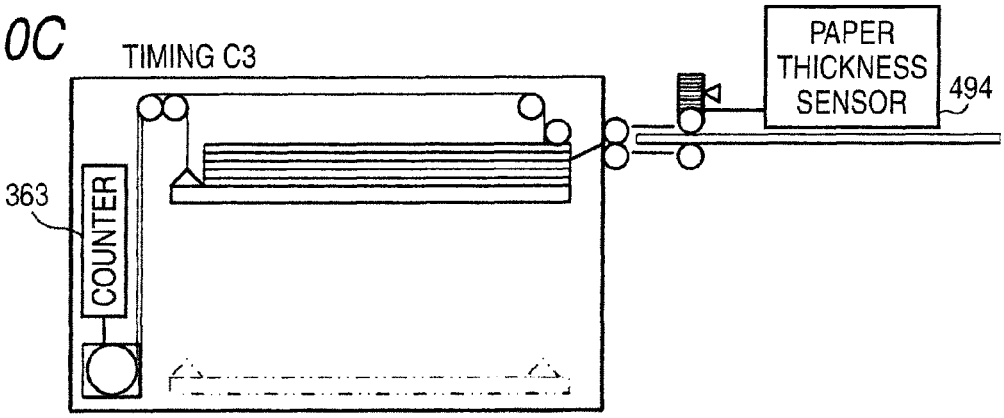
Figure 10D:
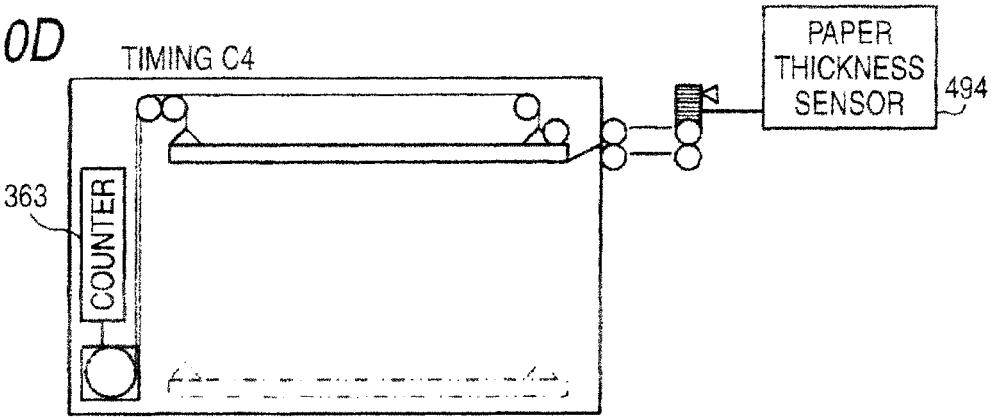

FIGS. 10A to 10D are specific examples of a remaining paper volume detecting process when a load quantity is small, and illustrate operation transition states, for example, in which the paper feed tray 41 on which A3 size paper whose quantity corresponds to the "Lower" level is loaded starts to be lifted up at timing C1 (see FIG. 10A), the lift-up operation to the paper feed position is completed at timing C2 (see FIG. 10B), the printing is executed while feeding paper and detecting a thickness of the paper after timing C3 (see FIG. 10C), and there is no paper within the paper feed tray 41 at timing C4 (see FIG. 10D).

Figure 11A:
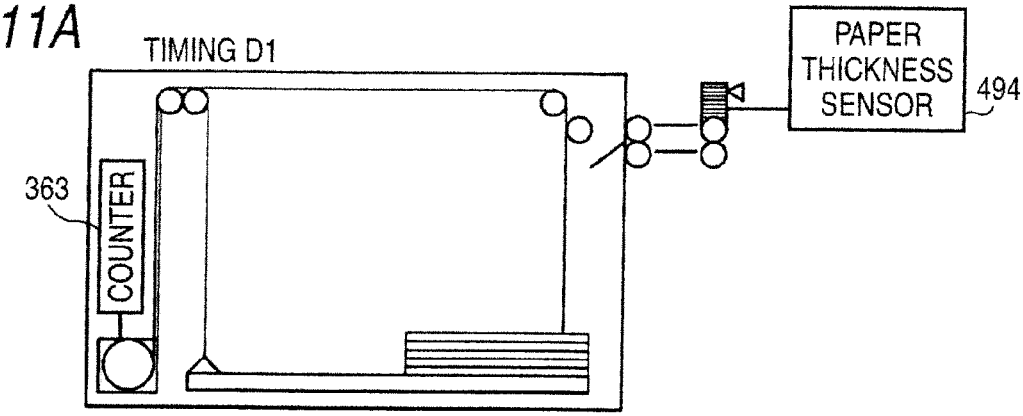
FIGS. 11A to 11D are diagrams showing operation transition related to a remaining paper volume calculating process at the time of a small load of a small size.
Figure 11B:
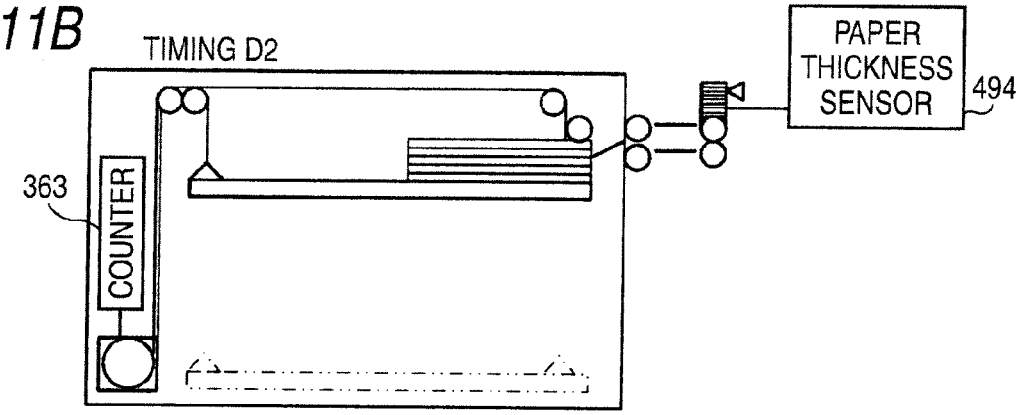
Figure 11C:
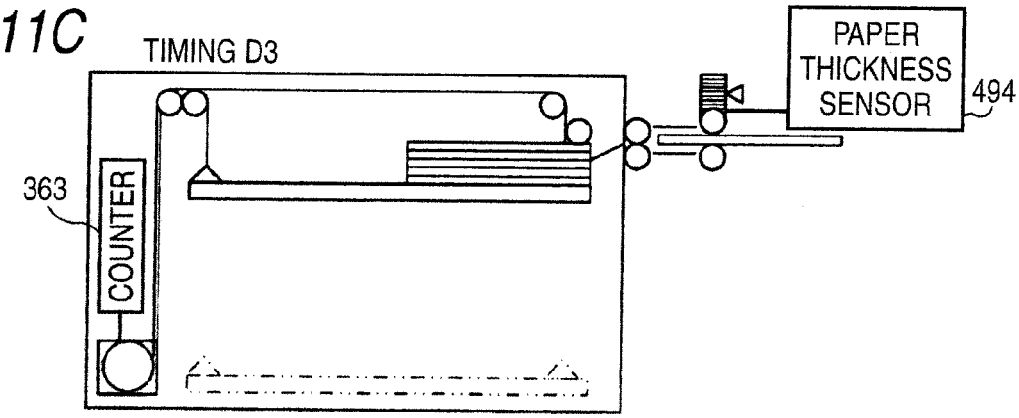
Figure 11D:
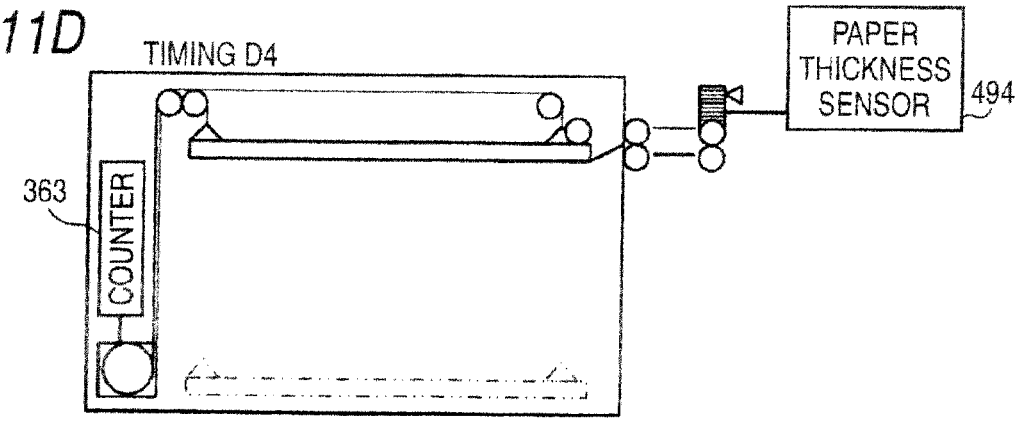

Likewise, FIGS. 11A to 11D are other specific examples of the remaining paper volume detecting process when the load quantity is large, and illustrate operation transition states, for example, in which the paper feed tray 41 on which A4 size paper whose quantity corresponds to the "Lower" level is loaded starts to be lifted up at timing D1 (see FIG. 11A), the lift-up operation to the paper feed position is completed at timing D2 (see FIG. 11B), the printing is executed while feeding paper and detecting a thickness of the paper after timing D3 (see FIG. 11 C), and there is no paper within the paper feed tray 41 at timing D4 (see FIG. 11D).

Figure 12:
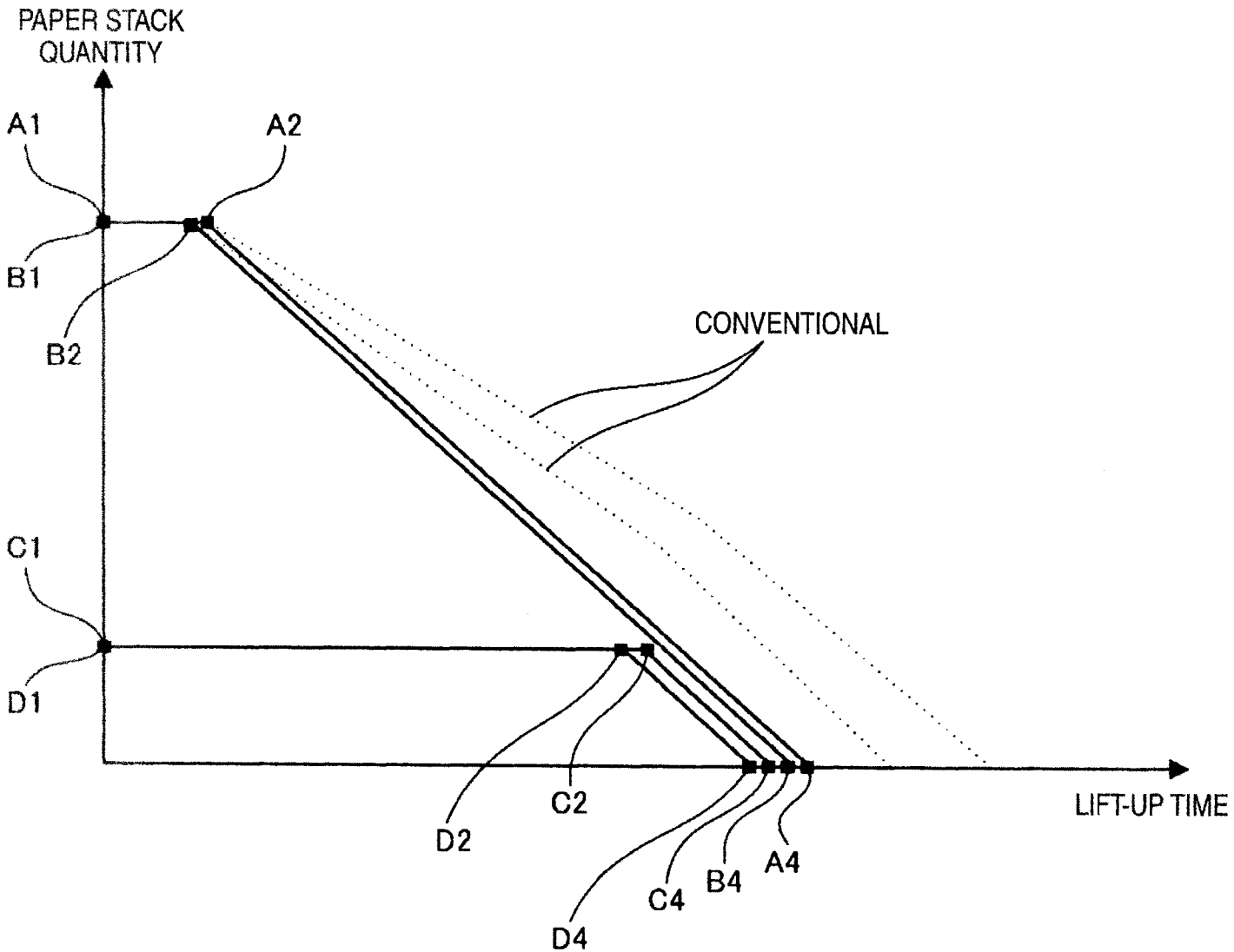
FIG. 12 is a diagram showing characteristics of a lift-up time to a paper stack quantity of a paper feed tray in a remaining sheet volume detecting apparatus of an example of the present invention.

FIG. 12 is a diagram showing paper stack quantity-lift up time characteristics of the paper feed tray 41 in the remaining sheet volume detecting apparatus mounted to the printer 30 as an example of the present invention.

Signs A1 to A4, B1 to B4, C1 to C4, and D1 to D4 shown in FIG. 12 respectively correspond to timings A1 to A4, B1 to B4, C1 to C4, and D1 to D4 shown in FIGS. 8A to 11D.

In the manner of comparing with characteristics of the present invention, characteristics of a lift-up time to a paper stack quantity (only in the case where a paper stack quantity is large) based on the related remaining sheet volume detecting method are indicated by the dotted line of FIG. 12.

From the paper stack quantity-lift up time characteristics indicated by the solid line according to the remaining sheet volume detecting apparatus of the present invention as shown in FIG. 12, the paper feed tray 41 that has started to be lifted up at timing A1 is completely lifted up at timing A2, for example, in the operation (the large size and large load) of the transition states shown in FIGS. 8A to 8D.

For example, in the operation (the small size and large load) of the transition states shown in FIGS. 9A to 9D, the paper feed tray 41 started to be lifted up at timing B1 is completely lifted up at timing B2.

Then, in the case of the present invention when the printing is executed, a thickness of paper fed upon printing is detected and remaining paper volume is calculated by subtracting the paper thickness from a stack quantity.

When the detected paper thickness is converted into a time (lift-up time), the lift-up time to the stack quantity upon printing (feeding) changes in a small variation state during timings A2 to A4 of FIG. 12 in the operation time of the transition states shown in FIGS. 8A to 8D and during timings B2 to B4 of FIG. 12 in the operation time of the transition states shown in FIGS. 9A to 9D.

Upon feeding, the detected paper thickness does not necessarily need to be converted into the lift-up time, and a remaining paper volume can be separately calculated.

In the present invention as described above, even when an initial stack quantity is large, a paper stack quantity is calculated on the basis of its lift-up time, and then high-precision remaining paper volume detection is performed by detecting a thickness of paper fed upon printing and sequentially subtracting it from the stack quantity.

In terms of remaining volume detection upon feeding, characteristics of a lift-up time to a paper stack quantity will be verified on the basis of a related remaining paper volume detecting method indicated by the dotted line in FIG. 12.

According to the characteristics based on the related method (only, correction based on paper information, etc., is not performed), for example, when a calculated remaining paper volume is converted into a time value since a remaining paper volume is calculated (updated) merely by subtracting the number of print sheets after lifting up at timing A2 in the operation time of the transition states shown in FIGS. 8A to 8D or after lifting up at timing B2 in the operation time of the transition states shown in FIGS. 9A to 9D, the lift-up time becomes a variation factor since a paper weight is changed greatly according to a size or paper quality when the initial stack quantity is large as indicated by the dotted line of FIG. 12.

Accordingly, since stack quantity-lift up time characteristics are those as indicated by the dotted line (variation is large with respect to the stack quantity) during timings A2 to A4 and during timings B2 to B4 of FIG. 12, high-precision detection cannot be expected.

From the paper stack quantity-lift up time characteristics indicated by the solid line according to the remaining sheet volume detecting apparatus of the present invention as shown in FIG. 12, the paper feed tray 41 that has started to be lifted up at timing C1 is completely lifted up at timing C2, for example, in the operation (the large size and small load) of the transition states shown in FIGS. 10A to 10D.

In the operation (the small size and small load) of the transition states shown in FIGS. 11A to 11D, the paper feed tray 41 that has started to be lifted up at timing D1 is completely lifted up at timing D2.

Then, when the transition to the printing is made, a paper thickness is detected and subtracted from the stack quantity (see characteristic variation between timings C2 to C4 and between timings D2 to D4 of FIG. 12), so that high-precision remaining paper volume detection can be performed.

As described with reference to FIGS. 6 to 12, the present invention can perform high-precision remaining paper volume detection based on an accurate paper thickness for updating remaining paper volume by simply subtracting the number of print sheets, since a set volume (paper load thickness) is detected on the basis of a movement amount of the paper feed tray 41 (a count value of the lift-up counter 363) upon paper setting, a thickness of fed paper upon feeding (printing) is detected, and the detected paper thickness is sequentially subtracted from the set volume.

In particular, in the present invention, high-precision remaining volume calculation is performed even when paper pieces of different thicknesses are mixed and loaded. This will be described in detail with reference to FIGS. 13 to 15.

Figure 13A:
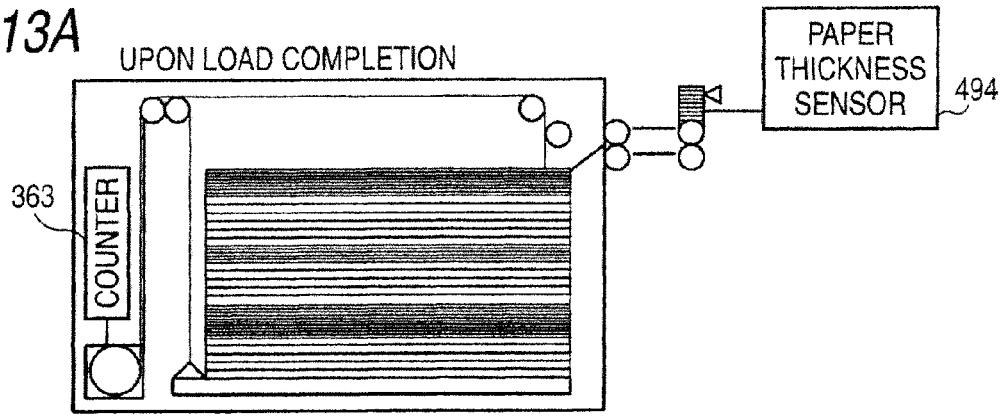
FIGS. 13A to 13D are diagrams showing operation transition related to a remaining paper volume calculating process when paper pieces of different thicknesses are loaded.
Figure 13B:
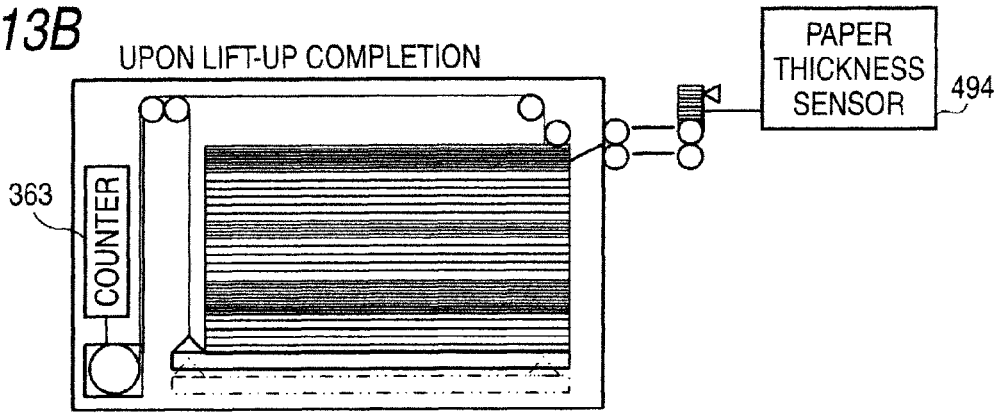
Figure 13C:
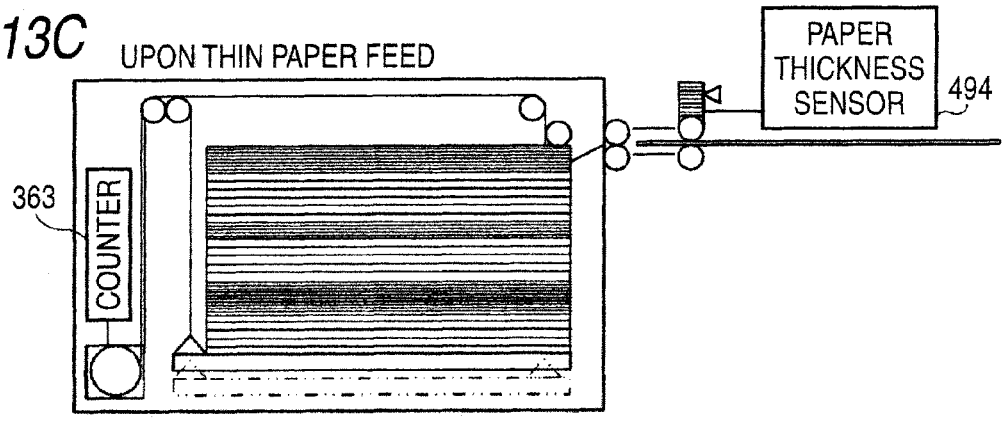
Figure 13D:
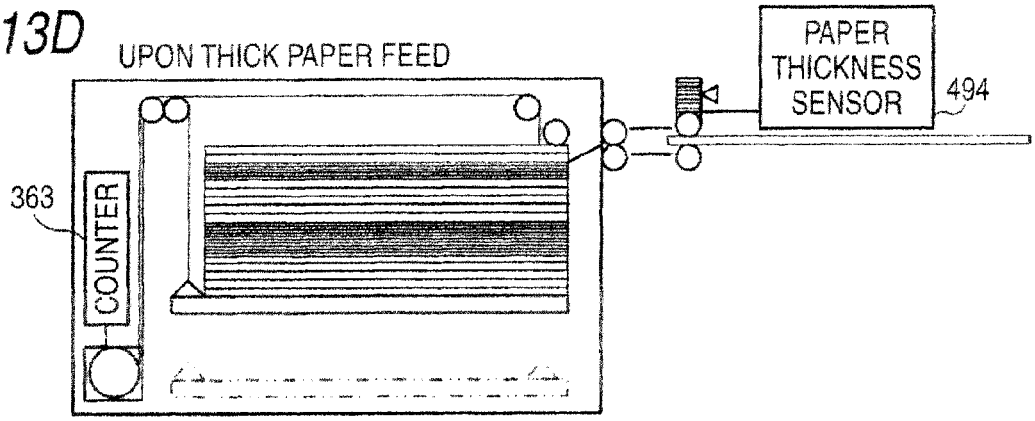

FIGS. 13A to 13D are diagrams showing operation transition states related to a remaining paper volume calculation process for the paper feed tray 41 on which plural of types of paper pieces with different thicknesses are loaded and, in particular, illustrates an operation transition state in which the plural types of paper pieces are loaded in a quantity corresponding to the "Full" level on the paper feed tray 41 (see FIG. 13A), the paper feed tray 41 starts to be lifted up and is lifted up to the paper feed position (see FIG. 13B), the printing is executed while feeding thin paper and detecting a paper thickness at one timing (see FIG. 13C), and the printing is executed while feeding thicker paper than the paper used in the previous printing and detecting a paper thickness at timing subsequent thereto (see FIG. 13D).

Figure 14A:
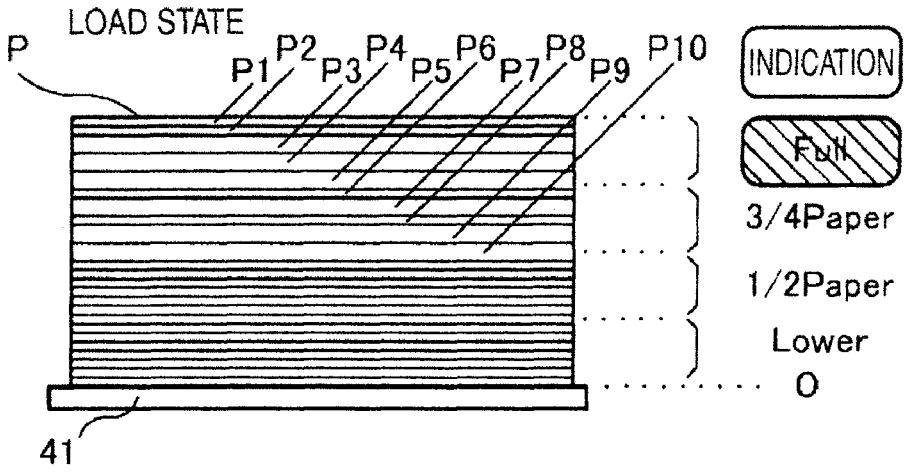
FIGS. 14A to 14C are conceptual diagrams showing an example of displaying a load state of paper within a paper feed tray and a detected remaining paper volume related to the operations of FIGS. 13A to 13D.
Figure 14B:
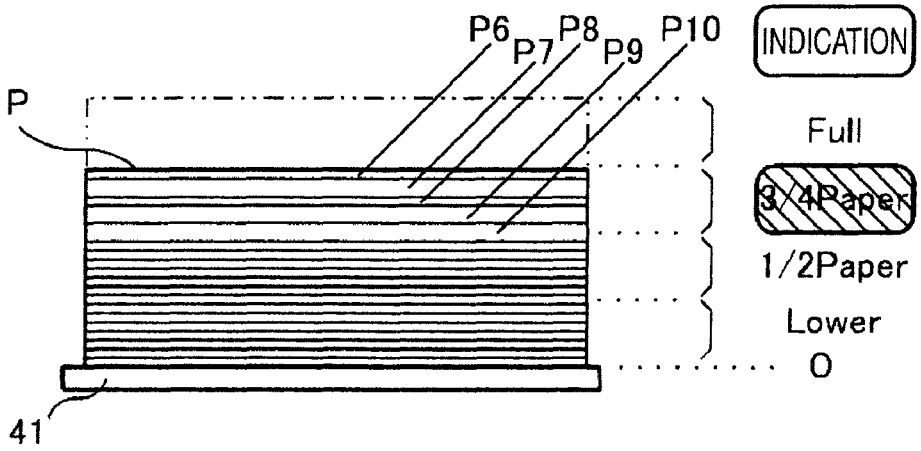
Figure 14C:
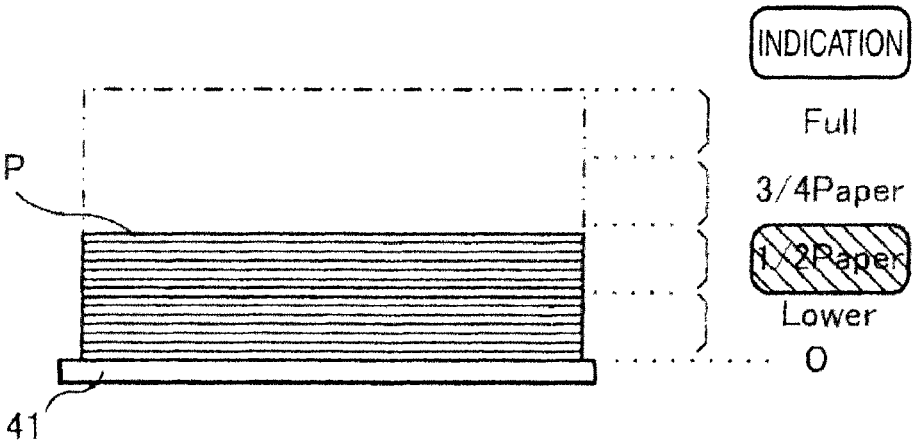

FIGS. 14A to 14C are conceptual diagrams showing a combination of a paper load state (the left portion of FIGS. 14A to 14C) within the paper feed tray 41 related to the operations shown in FIGS. 13A to 13D and a display example (the right portion of FIGS. 14A to 14C) of a remaining paper volume detected in the state.

FIG. 14A shows a display example of a remaining paper volume (set quantity: load thickness) calculated on the basis of a lift-up time related to the lift-up operation when the paper feed tray 41 on which paper pieces (plural types of paper pieces with different thicknesses) are loaded is lifted up to the paper feed position (see FIGS. 13A and 13B).

According to FIG. 14A, a set quantity corresponding to the maximum load quantity is detected on the basis of a lift-up count value of the paper feed tray 41 and "Full" is displayed as the remaining paper volume.

FIG. 14A illustrates a case where paper pieces indicated by, for example, signs P1, P2, P6, and P8, among plural of types of paper pieces having different thicknesses set on the paper feed tray 41 have a half thickness of paper pieces indicated by signs P3, P4, P5, P7, P9, and P10.

When the printing is started in the load state shown in FIG. 14A and, for example, 5 pages are completely printed, a remaining paper volume in which a thickness of the 5 paper sheets is subtracted from the set quantity is calculated and the transition to a state in which "¾ Paper" is displayed on the basis of the calculated remaining paper volume is made as shown in FIG. 14B.

When the printing is additionally started in the state shown in FIG. 14B and, for example, 5 additional pages are completely printed, a remaining paper volume in which a thickness of the 5 additional paper sheets is subtracted from the set quantity is calculated and the transition to a state in which "½ Paper" is displayed on the basis of the calculated remaining paper volume is made as shown in FIG. 14C.

Here, for comparison with a remaining paper volume calculating and displaying process, a process (related process) that calculates and displays a remaining paper volume by subtracting the number of paper sheets fed upon printing from a remaining paper volume calculated upon setting will be described.

Figure 15A:
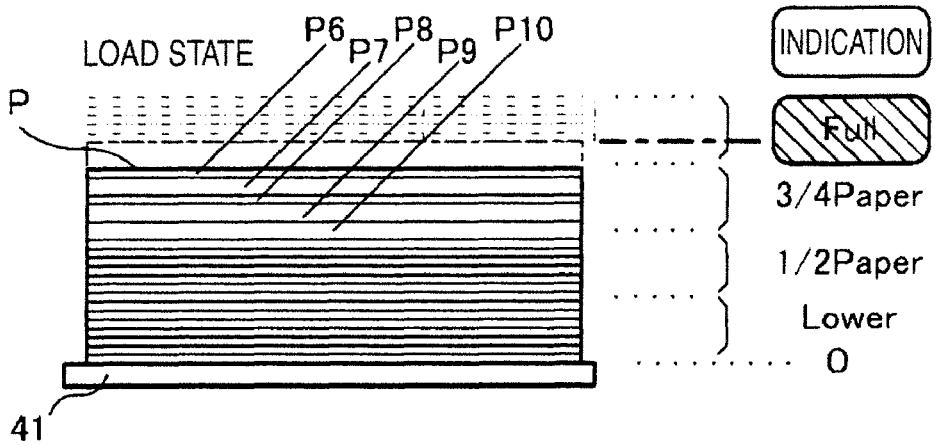
FIGS. 15A and 15B are conceptual diagrams showing an example of displaying a load state of paper within a paper feed tray and a detected remaining paper volume when a remaining paper volume is calculated in a related method.
Figure 15B:
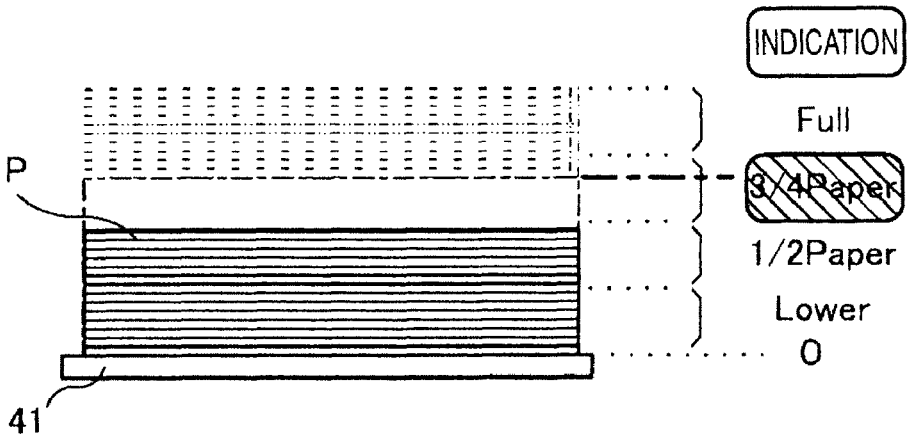

FIGS. 15A and 15B are conceptual diagrams showing the transition when a remaining paper volume is updated and displayed according to the number of print sheets from a state in which a remaining paper volume (set quantity: load thickness) is detected in a load state shown in FIG. 14A and "Full" is displayed as the remaining paper volume.

According to the related process that calculates the remaining paper volume according to the number of fed paper sheets, for example, as shown in FIG. 15A, the printing is started in the state shown in FIG. 14A, when the printing of 5 pages is completed, a remaining paper volume in which 5 paper sheets P1 to P5 are subtracted from the set quantity is calculated and "Full" is still displayed as the remaining paper volume on the basis of the calculated remaining paper volume.

When 5 pages are additionally printed from the state shown in FIG. 1 5A and the printing is completed, as shown in FIG. 15B, the transition to a state in which a remaining paper volume is calculated by additionally subtracting 5 paper sheets P6 to P10 from the set quantity and "¾ Paper" is displayed as the remaining paper volume is made.

When this is compared with an example of calculating and displaying a remaining paper volume according to the present invention, the remaining paper volume is calculated by subtracting a thickness of the 5 paper sheets from a set quantity and displayed at a level of "¾ Paper" matching an actual remaining paper volume, as shown in FIG. 14B, when the printing of 5 paper sheets ends in the present invention, while the remaining paper volume is calculated by subtracting a thickness of the 5 paper sheets from a set quantity and displayed at a level of "Full" different from the level of "¾ Paper" as the actual remaining paper volume, as shown in FIG. 15A, when the printing of 5 paper sheets ends in the related remaining paper volume calculating process.

When the printing ends after the printing of 5 additional paper sheets is completed, the remaining paper volume is calculated by subtracting a thickness of the 5 paper sheets from a set quantity and displayed at a level of "½ Paper" matching an actual remaining paper volume, as shown in FIG. 14C, in the present invention, while the remaining paper volume is calculated by subtracting a thickness of the 5 paper sheets from a set quantity and displayed at a level of "¾ Paper" different from the level of "½ Paper" as the actual remaining paper volume, as shown in FIG. 15B, in the related remaining paper volume calculating process.

As such, this exemplary embodiment realizes high-precision remaining sheet volume detection by calculating a set quantity on the basis of a movement amount of the paper feed tray 41 and accurately detecting a thickness of paper fed upon printing.

As described with reference to FIGS. 14A and 15B, the present invention can calculate an accurate remaining paper volume even when plural of types of paper pieces with different thicknesses are mixed and loaded.

Exemplary Embodiment 2

A printer (for convenience, denoted by 30B) related to an exemplary embodiment 2 has a paper feeder (likewise denoted by 40B) having a different structure from that of the exemplary embodiment 1, and therefore the structure of a remaining sheet volume detecting apparatus mounted to the printer 30B is also different from that of the exemplary embodiment 1.

Figure 16:
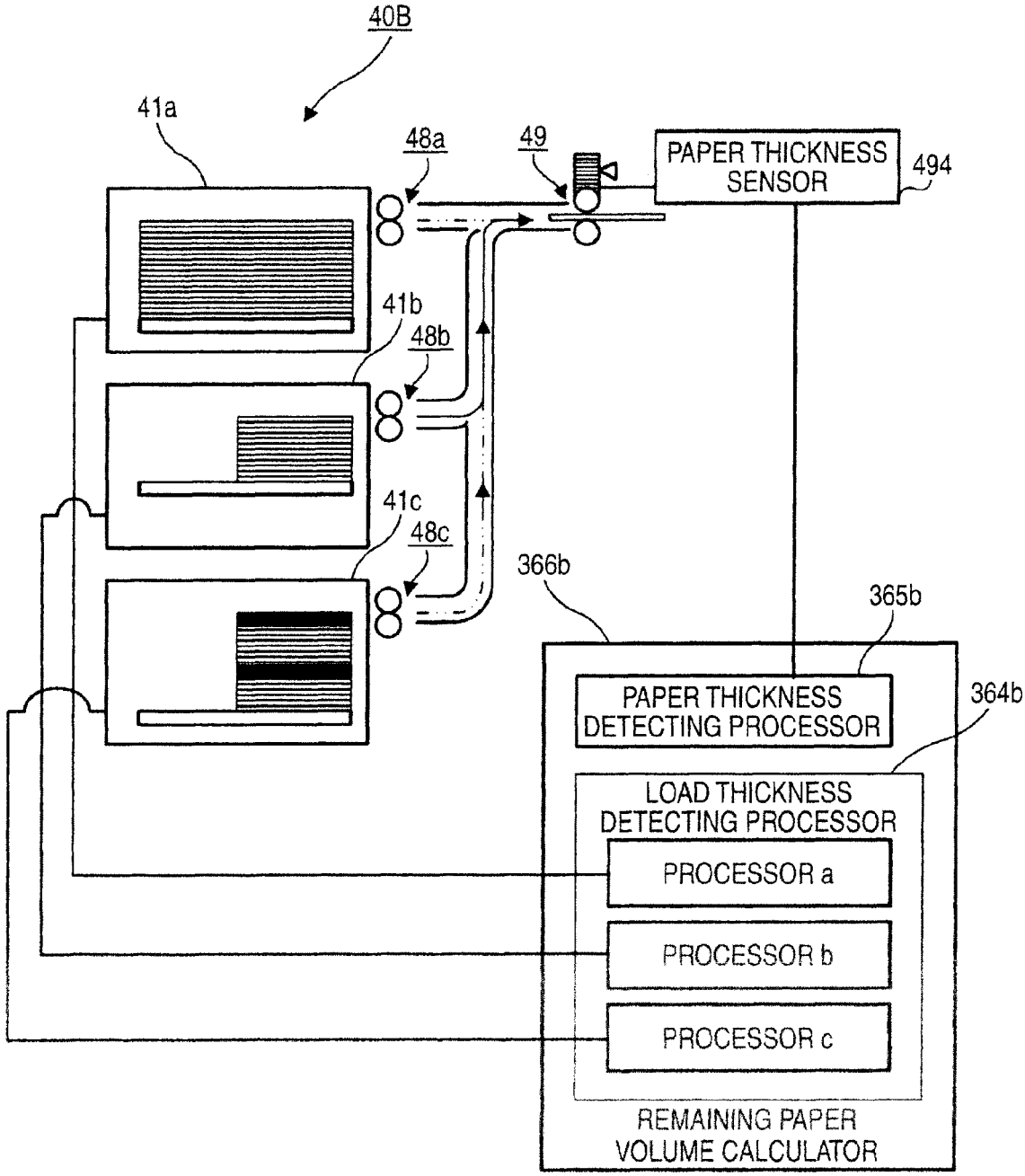
FIG. 16 is a conceptual diagram showing a structure of a paper feeder of a printer according to an exemplary embodiment 2.

FIG. 16 is a conceptual diagram showing a structure of the paper feeder 40B of the printer 30B according to the exemplary embodiment 2.

As shown in FIG. 16, the paper feeder 40B of the printer 30B has plural of paper feed trays 41*a*, 41*b*, and 41*c*.

For example, in the paper feed trays 41*a*, 41*b*, and 41*c*, a tray lift drive mechanism including the pulleys 42*a*, 42*b*, 42*c*, and 42*d*, the wire 43, the drive motor 44, the cam 45, the delivery roller 46, and the limit sensor 47 like the tray lift drive mechanism of the paper feed tray 41 according to the exemplary embodiment 1 (see FIG. 2) is individually provided, and also paper feed rollers 48*a*, 48*b*, and 48*c*, which transport paper delivered from the delivery roller 46 of the paper feed trays 41*a*, 41*b*, and 41*c*, are especially provided.

On the other hand, at a downstream side of a paper transport direction of the paper feed rollers 48*a*, 48*b*, and 48*c* of the paper feed trays 41*a*, 41*b*, and 41*c*, one paper thickness detecting roller 49 having the paper thickness sensor 494 (see FIG. 3) is provided as in the exemplary embodiment 1.

The paper feeder 40B of the printer 30B has a paper transport path structure in which paper-feed transport paths of the paper feed trays 41*a*, 41*b*, and 41*c* are joined together in the middle, and the paper thickness detecting roller 49 is provided in a paper-feed transport path after the join and used to detect a thickness of paper fed from the paper feed trays 41*a*, 41*b*, and 41*c* upon printing.

As shown in FIG. 16, the remaining sheet volume detecting apparatus mounted to the printer 30B includes a load thickness detecting processor 364*b*, a paper thickness detecting processor 365*b*, and a remaining paper volume calculator 366*b*.

The load thickness detecting processor 364*b*, the paper thickness detecting processor 365*b*, and the remaining paper volume calculator 366*b* are provided, for example, within a control unit (for convenience, denoted by 36*b*), along with a printer controller 361*b*, a tray lift controller 362*b*, a tray lift counter 363*b*, and a remaining paper volume reporter 367*b* that are not shown.

That is, in the printer 30B of this exemplary embodiment [having the same function block structure of the entire apparatus as the printer 30 according to the exemplary embodiment (see FIG. 1)], the control unit 36*b* includes the printer controller 361*b*, the tray lift controller 362*b*, the tray lift counter 363*b*, the load thickness detecting processor 364*b*, the paper thickness detecting processor 365*b*, the remaining paper volume calculator 366*b*, and the remaining paper volume reporter 367*b*.

For example, on the basis of a print instruction from the client terminal 10, the print controller 361*b* performs a control operation to print a print instruction document by selectively feeding paper from a paper feed tray designated by the print instruction (or a specified paper feed tray accommodating a type of paper designated by the print instruction) among the plural paper feed trays 41*a*, 41*b*, and 41*c*.

The tray lift controller 362*b* controls the lift-up operation of a corresponding paper feed tray by selectively driving tray lift drive mechanisms provided in correspondence with the paper feed trays 41*a*, 41*b*, and 41*c*.

The lift-up counter 363*b* includes, for example, a counter provided in correspondence with each of the paper feed trays 41*a*, 41*b*, and 41*c*. Each counter counts a lift-up time of the corresponding paper feed tray.

The load thickness detecting processor 364*b* has processors (processors a, b, and c of FIG. 16), which correspond to the paper feed trays 41*a*, 41*b*, and 41*c* and detect a total load thickness of sheets loaded on each corresponding paper feed tray on the basis of a time (a count value of the lift-up counter 363*b*) until each paper feed tray 41*a*, 41*b*, or 41*c* is lifted up to the paper feed position.

The paper thickness detecting processor 365*b* detects a thickness of paper fed from each paper feed tray 41*a*, 41*b*, or 41*c* upon printing by identifying a paper feed tray of a paper feed source of the paper.

The remaining paper volume calculator 366*b* calculates a remaining volume of sheets loaded on each paper feed tray 41*a*, 41*b*, or 41*c* on the basis of the thickness of fed paper detected by identifying each paper feed tray 41*a*, 41*b*, or 41*c* of the paper feed source by the paper thickness detecting processor 365*b* and a total sheet load thickness detected by the load thickness detecting processor 364*b* in correspondence with the identified paper feed tray 41*a*, 41*b*, or 41*c* of the paper feed source.

The remaining paper volume reporter 367*b* performs a process of reporting a remaining paper volume of each paper feed tray 41*a*, 41*b*, or 41*c* calculated by the remaining paper volume calculator 366*b* in correspondence with each paper feed tray 41*a*, 41*b*, or 41*c*.

Figure 17:
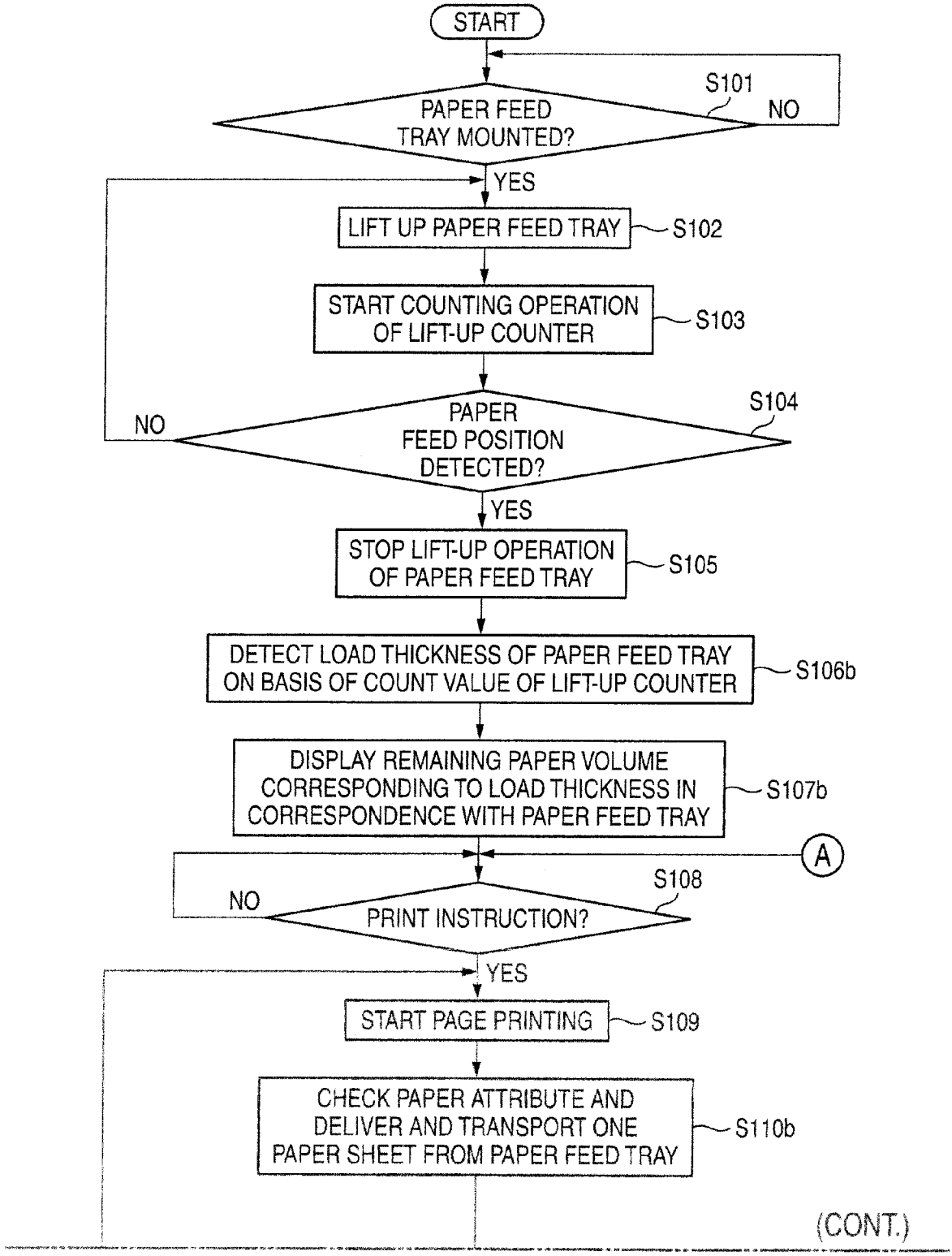
FIG. 17 is a flowchart showing a remaining paper volume calculating process operation of the printer according to the exemplary embodiment 2.

FIG. 17 is a flowchart showing a remaining paper volume calculating process operation of the printer 30B according to this exemplary embodiment.

In FIG. 17, the same processing steps as those shown in FIG. 6 are denoted by the same reference numerals. Here, a series of remaining paper volume calculating process operations mainly based on the processes of unique steps S106*b*, S107*b*, S110*b*, S113*b*, and S114*b* of this exemplary embodiment will be described.

In FIG. 17, for example, when paper is loaded on the paper feed tray 41*a* and mounted to the apparatus main body (step S101: YES), the tray lift controller 362*b* drives a corresponding tray lift drive mechanism to start a lift-up operation of the paper feed tray 41*a* (step S102), causes the lift-up counter 363*b* to start a counting operation of a lift-up time corresponding to the paper feed tray 41*a* (step S103), and stops the lift-up operation of the paper feed tray 41*a* and the counting operation of the lift-up counter 363*b* (step S105) when it is determined that the paper feed position has been reached according to a detection output from the limit sensor 47 corresponding to the paper feed tray 41*a* (step S104: YES).

Subsequently, the load thickness detecting processor 364*b* (the processor a) detects a total thickness of paper loaded on the paper feed tray 41*a* using the above-described Expression (1) on the basis of a count value of the lift-up counter 363*b* (a lift-up time of the paper feed tray 41*a*) (step S106), and the remaining paper volume reporter 367*b* displays a remaining paper volume corresponding to a load thickness within the paper feed tray 41*a*, for example, on the display unit of the display/operation unit 35 (step S107*b*).

Likewise, when paper is loaded on the paper feed tray 41*b* (or 41*c*) and mounted to the apparatus main body, the load thickness detecting processor 364*b* (the processor b) [equally, the load thickness detecting processor 364*b* (the processor c)] detects a load thickness of paper of the paper feed tray 41*b* (equally, 41*c*) on the basis of the lift-up time of the paper feed tray 41*b* (equally, 41*c*) (steps S101 to 106*b*), and the remaining paper volume reporter 367*b* displays a remaining paper volume corresponding to the detected load thickness on the display unit in correspondence with the paper feed tray 41*b* (equally, 41*c*) (step S107*b*).

As described above, if a print instruction is given (step S108) after a paper load thickness for each paper feed tray 41*a*, 41*b*, or 41*c* is detected upon paper setting to each paper feed tray 41*a*, 41*b*, or 41*c* and a remaining paper volume corresponding to the load thickness is displayed in correspondence with each paper feed tray 41*a*, 41*b*, or 41*c*, the print controller 361*b* starts the printing of a first page of a print-instructed document (step S109) and then a paper attribute is detected from print instruction content and paper having the paper attribute is loaded. For example, the paper feed tray 41*a* is specified and one paper sheet is delivered and transported from the paper feed tray 41*a* in synchronization with paper feed timing (step S110*b*).

During the paper transport, the paper thickness detecting processor 365*b* receives a detection output of the paper thickness sensor 494 when fed paper passes between facing rollers of the paper thickness detecting roller 49 (step S111) and detects a thickness of paper being transported from the detection output (step S112).

Subsequently, on the basis of a specific result that the paper feed tray 41*a* of step 110*b* is a paper feed source, the remaining paper volume calculator 366*b* calculates remaining volume of paper loaded on the paper feed tray 41*a* of the paper feed source on the basis of a total load thickness of paper detected by the load thickness detecting processor 364*b* (the processor a) corresponding to the paper feed tray 41*a* of the paper feed source in step S1105, and the thickness of one paper sheet of which the paper feed source is the paper feed tray 41*a*, detected by the paper thickness detecting processor 365*b* (the processor a) (step S113*b*).

The remaining paper volume reporter 367*b* displays the remaining paper volume of the paper feed tray 41*a* calculated in step S113*b* on the display unit of the display/operation unit 35 in correspondence with the paper feed tray 41*a* (step S114*b*).

Subsequently, while it is determined that the next page exists (step S115: YES), the remaining paper volume is updated by subtracting remaining volume corresponding to a thickness of one sheet from the displayed remaining paper volume of the paper feed tray 41*a* of the paper feed source when a paper thickness of this page to be printed is detected in the same way after the printing of a first sheet is started (step S113*b*), and the updated remaining paper volume is displayed on the display unit (step S114*b*). When it is determined that the next page does not exist (step S115: NO), the process ends and the transition to the standby state is made.

It is monitored whether or not a print instruction exists even in the standby state. Whenever the print instruction exists (step S108), a process is performed to detect a thickness of fed paper, update a remaining paper volume by subtracting the detected thickness corresponding to one paper sheet from a remaining paper volume of the paper feed tray 41*a* of the paper feed source at the time, and display the updated remaining paper volume, as described above (steps S109 to S115).

Likewise, even when the paper is fed from the paper feed tray 41*b* (or 41*c*) and the printing is executed, the remaining paper volume calculator 365*b* detects a thickness of paper in correspondence with the paper feed tray 41*b* (equally, 41*c*) of the paper feed source (steps S108 to S112), the remaining paper volume corresponding to the paper feed tray 41*b* (equally, 41*c*) is calculated by sequentially subtracting the detected thickness of paper of which the paper feed source is the paper feed tray 41*b* (equally, 41*c*) from the load thickness detected by the load thickness detecting processor 364*b* (the processor b) [equally, the load thickness detecting processor 364*b* (the processor c)] in correspondence with the paper feed tray 41*b* (equally, 41*c*) (step S113*b*), and the remaining paper volume reporter 367*b* displays the calculated remaining paper volume corresponding to the paper feed tray 41*b* (equally, 41*c*).

In this exemplary embodiment as described above, in the structure of the remaining sheet volume detecting apparatus in which the plural paper feed trays 41*a*, 41*b*, and 41*c* are provided and a remaining paper volume of each corresponding paper feed tray 41*a*, 41*b*, or 41*c* is calculated on the basis of a load thickness calculated on the basis of a lift-up time of each paper feed tray 41*a*, 41*b*, or 41*c* and a thickness of paper fed from each corresponding paper feed tray 41*a*, 41*b*, or 41*c*, one paper thickness detecting unit (the paper thickness sensor 494) is used to detect the thickness of paper fed from each paper feed tray 41*a*, 41*b*, or 41*c*.

In addition, the present invention is not limited to the above-described exemplary embodiments shown in the drawings, and appropriate modifications can be made within the scope without changing the subject matter thereof.

For example, in each exemplary embodiment as described above, a structure in which the lift-up operation of the paper feed tray 41 is started, a movement time of the paper feed tray 41 (a lift-up time of the paper feed tray 41: an operation time of the paper feed tray 41 by the drive motor 44) until the paper feed position is reached is detected, and a paper load thickness (set quantity) is calculated on the basis of the lift-up time has been illustrated, but the present invention can detect a paper load thickness of a paper feed tray upon sheet setting on the basis of a movement amount of the paper feed tray 41 until the paper feed position is reached after the lift-up operation of the paper feed tray is started. The movement amount of the paper feed tray 41 to be used for the detection is not limited to the above-described movement time, and may be a movement length (distance).

As a specific example, a pulse motor is used as the drive motor 44. While the paper feed tray 41 is driven, a pulse signal of the pulse motor is counted and a movement amount (movement distance) of the paper feed tray 41 is detected from a count value, so that a paper load thickness of the paper feed tray 41 may be detected from the movement amount.

For example, in each exemplary embodiment described above, the dedicated paper thickness sensor 494 is provided as a mechanism to detect a thickness of paper to be fed. Alternatively, for example, when an overlap feed detecting unit is provided to detect the paper thickness by the thickness detecting sensor upon paper feed and detect overlap feed in which plural of paper pieces are overlapped and transported on the basis of the detected paper thickness, the thickness detecting sensor constituting the overlap feed detecting unit may be configured to be used as the paper thickness sensor 494.

In each exemplary embodiment described above, a structure in which the limit sensor 47 is used to detect that the paper feed tray 41 has been lifted up to the paper feed position has been illustrated, but it is not limited thereto. For example, various detecting mechanisms may be adopted to detect a lift-up time (an operation time of the drive motor) by recognizing that set paper is in contact with the delivery roller and the rotation of the drive roller is stopped.

In each exemplary embodiment described above, a printer that processes a print job from the client terminal 10 has been illustrated, but the present invention is applicable to a general image forming apparatus having a mechanism to feed loaded paper in a state in which the paper feed tray is lifted up to the paper feed position, such as a compound device that executes printing on the basis of a print instruction (print start instruction or copy start instruction) from a local terminal.

The present invention can be applied to an apparatus that detects remaining volume of sheets loaded on a sheet loading unit, and, in particular, is suitable for an apparatus that detects remaining volume of paper within a paper feed tray in an image forming apparatus having the paper feed tray on which recoding paper as a sheet is loaded.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A remaining sheet volume detecting apparatus, comprising:

a first loading unit that loads sheets;

a first driving unit that lifts up the first loading unit to a feed position of a loaded sheet;

a first feeding unit that feeds the sheet from the first loading unit that has reached the feed position;

a load thickness detecting unit that detects a load thickness of sheets within the first loading unit based on a movement amount of the first loading unit until the first loading unit reaches the sheet feed position after a lift-up operation of the first loading unit is started by the first driving unit;

a sheet thickness detecting unit that detects a thickness of the sheet fed by the first feeding unit from the first loading unit that has reached the feed position; and a remaining sheet volume calculating unit that calculates remaining volume of sheets within the first loading unit based on the load thickness detected by the load thickness detecting unit and the sheet thickness detected by the sheet thickness detecting unit.

2. The remaining sheet volume detecting apparatus of claim 1, wherein the remaining sheet volume calculating unit calculates the remaining sheet volume by sequentially subtracting the sheet thickness detected by the sheet thickness detecting unit from the load thickness detected by the load thickness detecting unit, when the sheet is fed by the first feeding unit.

3. The remaining sheet volume detecting apparatus of claim 1, further comprising:

an overlap feed detecting unit that detects the thickness of the fed sheet by a thickness detecting sensor and detects overlap feed in which a plurality of sheets are overlapped and transported based on the detected sheet thickness, wherein the sheet thickness detecting unit includes the thickness detecting sensor of the overlap feed detecting unit.

4. The remaining sheet volume detecting apparatus of claim 1, further comprising:

a second loading unit; and a second driving unit and a second feeding unit provided in correspondence with the second loading unit, wherein the sheet thickness detecting unit is provided in a joint transport path where paper-feed transport paths of the first and the second loading units are joined, the load thickness detecting unit detects a load thickness of sheets within each loading unit based on a movement amount of each loading unit until each loading unit reaches the sheet feed position after a lift-up operation of each loading unit is started by each driving unit, the sheet thickness detecting unit detects a thickness of a sheet fed by each feeding unit from each loading unit that has reached the feed position in correspondence with each loading unit, and the remaining sheet volume calculating unit calculates the remaining sheet volume of each loading unit based on the sheet thickness detected by the sheet thickness detecting unit in correspondence with each loading unit and the load thickness detected by the load thickness detecting unit in correspondence with each loading unit.

5. The remaining sheet volume detecting apparatus of claim 1, wherein the load thickness detecting unit detects the movement amount of the loading unit as a movement time of the loading unit until the loading unit reaches the sheet feed position after the lift-up operation of the loading unit is started by the driving unit, and detects a load thickness of sheets within the loading unit based on the detected movement time of the loading unit.

6. An image forming apparatus comprising:

a paper loading unit that loads papers to be used as a recording medium;

a driving unit that lifts up the paper loading unit to a feed position of a loaded paper;

a feeding unit that feeds the paper from the paper loading unit that has reached the feed position;

a load thickness detecting unit that detects a load thickness of the papers within the loading unit based on a movement amount of the paper loading unit until the paper loading unit reaches the paper feed position after a lift-up operation of the paper loading unit is started by the driving unit;

a paper thickness detecting unit that detects a thickness of the paper fed by the feeding unit from the paper loading unit that has reached the feed position;

a remaining paper volume calculating unit that calculates remaining paper volume within the loading unit based on the load thickness detected by the load thickness detecting unit and the paper thickness detected by the paper thickness detecting unit; and a displaying unit that displays the remaining paper volume calculated by the remaining paper volume calculating unit.

* * * * *